US010470638B2

(12) United States Patent
Patterson et al.

(10) Patent No.: US 10,470,638 B2
(45) Date of Patent: Nov. 12, 2019

(54) HARD SURFACE CLEANING DEVICES

(71) Applicant: Unger Marketing International, LLC, Bridgeport, CT (US)

(72) Inventors: Joseph K. Patterson, Monroe, CT (US); James M. Buckley, New Hartford, CT (US); John Lombardo, Ridgefield, CT (US); Stephen Huda, Shelton, CT (US); Paul H. Adams, Monroe, CT (US); Bryan Lee Roberts, Jr., Dormagen (DE); Frank Wilde, Essen (DE)

(73) Assignee: UNGER MANAGEMENT INTERNATIONAL, LLC, Bridgeport, CT (US)

( * ) Notice: Subject to any disclaimer, the term of this patent is extended or adjusted under 35 U.S.C. 154(b) by 108 days.

(21) Appl. No.: 15/849,797

(22) Filed: Dec. 21, 2017

(65) Prior Publication Data

US 2018/0110391 A1 Apr. 26, 2018

Related U.S. Application Data

(62) Division of application No. 14/983,883, filed on Dec. 30, 2015, now Pat. No. 9,877,631.

(Continued)

(51) Int. Cl.

*B08B 3/00* (2006.01)
*A47L 13/22* (2006.01)

(Continued)

(52) U.S. Cl.

CPC ..... *A47L 13/22* (2013.01); *A46B 11/001* (2013.01); *A46B 11/002* (2013.01); *A47L 1/08* (2013.01);

(Continued)

(58) Field of Classification Search

None

See application file for complete search history.

(56) References Cited

U.S. PATENT DOCUMENTS 2,104,161 A 12/1934 Koukal
4,776,716 A 10/1988 Huang (Continued)

FOREIGN PATENT DOCUMENTS

CA 2730814 8/2011
CA 2893297 6/2014

(Continued)

OTHER PUBLICATIONS

US 9,877,641 B2, 01/2018, Patterson et al. (withdrawn)

(Continued)

*Primary Examiner* — Eric W Golightly
(74) *Attorney, Agent, or Firm* — Cantor Colburn LLP

(57) ABSTRACT

A method of cleaning a surface, comprising: providing a cleaning head, a housing, and a pump, the pump having a port, the cleaning head having a nozzle, and the cleaning head and housing being connected to one another; attaching a cleaning element with a first opening to the cleaning head so that the nozzle and the first opening are in registration; providing a flexible pouch having a cleaning fluid therein; connecting the port and the flexible pouch to form an air and fluid tight connection between the port and the flexible pouch; placing the cleaning element on a surface to be cleaned; and pumping, via the pump, the cleaning fluid from the flexible pouch through the nozzle and the first opening onto the surface to be cleaned.

13 Claims, 22 Drawing Sheets

Related U.S. Application Data

(60) Provisional application No. 62/185,382, filed on Jun. 26, 2015.

(51) Int. Cl.

| | |
|---|---|
| ***A46B 11/00*** | (2006.01) |
| ***A47L 1/08*** | (2006.01) |
| ***A47L 13/44*** | (2006.01) |
| ***B08B 1/00*** | (2006.01) |
| *B08B 3/02* | (2006.01) |

(52) U.S. Cl.

CPC ..... *A47L 13/44* (2013.01); *B08B 1/00* (2013.01); *B08B 3/026* (2013.01)

(56) References Cited

U.S. PATENT DOCUMENTS 4,863,299 A 9/1989 Osberghaus et al.
5,271,682 A 12/1993 Realdon
D361,669 S 8/1995 Chan et al.
5,515,574 A 5/1996 Larson
5,735,620 A 4/1998 Ford
5,771,535 A 6/1998 Blessing
5,888,006 A 3/1999 Ping et al.
6,142,750 A 11/2000 Benecke
6,497,525 B1 12/2002 Huang
6,540,424 B1 4/2003 Hall et al.
6,551,001 B2 4/2003 Aberegg et al.
6,579,023 B2 6/2003 Kunkler et al.
6,612,768 B2 9/2003 Zorzo
D483,242 S 12/2003 Heathcock
6,655,866 B1 12/2003 Morad et al.
6,659,670 B1 12/2003 Blouse
6,663,306 B2 12/2003 Policicchio et al.
6,669,391 B2 12/2003 Policicchio et al.
6,722,806 B2 4/2004 Kunkler et al.
6,726,388 B1 4/2004 Monahan
6,854,911 B2 2/2005 Policicchio et al.
6,854,912 B2 2/2005 Dyer et al.
6,893,180 B2 5/2005 Hall et al.
6,899,485 B2 5/2005 Hall et al.
6,953,299 B2 10/2005 Wang et al.
6,960,042 B1 11/2005 Hsiao
6,964,535 B2 11/2005 Bell et al.
6,981,533 B2 1/2006 Zorzo
6,986,618 B2 1/2006 Hall et al.
6,986,619 B2 1/2006 Hall et al.
7,004,658 B2 2/2006 Hall et al.
D520,852 S 5/2006 Minkler
D520,854 S 5/2006 Barrett
7,048,458 B2 5/2006 Hall et al.
7,048,804 B2 5/2006 Kisela et al.
7,056,050 B2 6/2006 Sacks
7,159,275 B2 1/2007 Chang
7,160,044 B2 1/2007 Dyer et al.
7,163,349 B2 1/2007 Policicchio et al.
7,172,099 B2 2/2007 Hofte et al.
7,191,486 B1 3/2007 Michelson et al.
7,431,524 B2 10/2008 Sacks
7,530,136 B1 5/2009 Ball
7,618,206 B2 11/2009 Sacks
7,699,551 B2 4/2010 Suda et al.
7,708,485 B2 5/2010 Tanaka et al.
7,722,273 B2 5/2010 Tanaka et al.
7,779,501 B2 * 8/2010 Lacotta ..... A47L 13/256 15/115
7,850,384 B2 12/2010 Sacks
D632,090 S 2/2011 Cobabe et al.
D632,490 S 2/2011 Cobabe et al.
D632,491 S 2/2011 Lowe
D633,362 S 3/2011 Ayala
D644,907 S 9/2011 Blanchard
8,069,520 B2 12/2011 Mattucci et al.
8,079,770 B2 12/2011 Widmer et al.
8,096,723 B2 1/2012 Bae
8,109,685 B1 2/2012 Vito
D655,146 S 3/2012 Lucio et al.
D661,036 S 5/2012 Raven
8,186,898 B2 5/2012 Bradbury et al.
8,205,293 B2 6/2012 Rosenzweig et al.
8,241,427 B1 8/2012 Crawford et al.
8,267,607 B2 9/2012 Harris
D670,151 S 11/2012 Angel
8,425,137 B1 4/2013 Sampaio
8,449,212 B2 5/2013 Crawford et al.
8,596,896 B2 12/2013 Kimura
8,641,309 B2 2/2014 Perry et al.
8,662,778 B2 3/2014 Crawford et al.
8,667,637 B2 3/2014 Vrdoljak et al.
D710,665 S 8/2014 Boies
8,807,858 B2 8/2014 Fitzpatrick et al.
8,834,053 B2 9/2014 Van Landingham, Jr. et al.
8,844,088 B2 9/2014 Garcia Castillo
D715,560 S 10/2014 Li
8,894,315 B2 11/2014 Dingert et al.
8,926,210 B2 1/2015 Orubor
8,927,480 B2 1/2015 Williams et al.
9,009,920 B1 4/2015 Ramsey
9,044,132 B2 6/2015 Kaminer et al.
D778,068 S 2/2017 Harrington
D789,637 S 6/2017 Dobson, III
D789,764 S 6/2017 Meier et al.
D793,640 S 8/2017 Buckley et al.
D803,658 S 11/2017 Perez et al.
2002/0166573 A1 11/2002 Policicchio et al.
2003/0103795 A1 6/2003 Hollars et al.
2003/0126710 A1 7/2003 Policicchio et al.
2003/0204926 A1 11/2003 Jurgens
2004/0146333 A1 7/2004 Fu
2004/0223803 A1 11/2004 Fahy et al.
2005/0031404 A1 2/2005 Tsai et al.
2005/0066465 A1 3/2005 Minkler et al.
2005/0089360 A1 4/2005 Garabedian, Jr. et al.
2005/0144744 A1 7/2005 Thiess et al.
2005/0191116 A1 9/2005 Flanery et al.
2005/0254882 A1 11/2005 Hofte et al.
2006/0039743 A1 2/2006 Mensink et al.
2006/0110207 A1 5/2006 Augustinus Hofte et al.
2006/0140703 A1 6/2006 Sacks
2006/0213017 A1 9/2006 Bele et al.
2006/0222441 A1 10/2006 Tanaka et al.
2007/0140774 A1 6/2007 Dyer et al.
2007/0231046 A1 10/2007 Whiffen et al.
2008/0038045 A1 2/2008 Hofte et al.
2008/0066242 A1 3/2008 Aiyar
2008/0115302 A1 5/2008 Kilkenny et al.
2008/0205972 A1 8/2008 LaFlamme et al.
2009/0094791 A1 4/2009 Blom
2010/0043167 A1 2/2010 Bradbury et al.
2011/0158740 A1 6/2011 Kandasamy et al.
2012/0227763 A1 9/2012 Hayes et al.
2012/0311805 A1 12/2012 Hasegawa
2013/0263396 A1 10/2013 Crawford et al.
2013/0263398 A1 10/2013 Irwin et al.
2014/0259510 A1 9/2014 Conrad
2014/0317868 A1 10/2014 Fitzpatrick et al.
2015/0082570 A1 3/2015 Davidshofer et al.
2015/0089757 A1 4/2015 Davidshofer et al.
2015/0101140 A1 4/2015 Pierce
2015/0201820 A1 7/2015 Escobar et al.
2015/0272308 A1 * 10/2015 Harrington ..... A46B 5/0075 134/6
2015/0297054 A1 10/2015 Weeks et al.
2015/0305588 A1 10/2015 Freudenberg
2016/0029859 A1 2/2016 Harrington
2016/0073847 A1 3/2016 Powell
2016/0374532 A1 12/2016 Patterson et al.

(56) References Cited

U.S. PATENT DOCUMENTS

| | | | |
|---|---|---|---|
| 2018/0344124 | A1 | 12/2018 | Patterson |
| 2019/0159650 | A1 | 5/2019 | Patterson |

FOREIGN PATENT DOCUMENTS

| | | | | |
|---|---|---|---|---|
| CA | 2952203 | A1 | 12/2016 | |
| EP | 3145382 | A1 | 3/2017 | |
| WO | 2008103803 | A1 | 8/2008 | |
| WO | WO-2014090350 | A2 * | 6/2014 | ..... A47L 13/22 |
| WO | 2016209315 | A1 | 12/2016 | |

OTHER PUBLICATIONS

HooverTwinTank_2011_Manual, 13 pages.
International Search Report and Written Opinion for International Application No. PCT/US2017/51621 dated Dec. 11, 201; 11 pgs.
International Search Report and Written Opinion for International Application No. PCT/US2015/068212 dated Feb. 25, 2016; 44 pgs.
Canadian Office Action for Application No. 2,952,203 dated Jun. 15, 2018; 3 pgs.
European Search Report for Application No. 15895150.9 dated Jun. 21, 2018; 8 pgs.

* cited by examiner

HARD SURFACE CLEANING DEVICES

CROSS REFERENCE TO RELATED APPLICATIONS

This application is a divisional application of U.S. application Ser. No. 14/983,883 filed on Dec. 30, 2015, and issued as U.S. Pat. No. 9,877,631 on Jan. 30, 2018, which claims the benefit of U.S. Provisional Application Ser. No. 62/185,382 filed Jun. 26, 2015, the contents of both of which are incorporated by reference herein.

BACKGROUND

1. Field of the Disclosure

The present disclosure is related to cleaning devices. More particularly, the present disclosure is related to cleaning devices that spray cleaning fluids to assist the cleaning of hard surfaces.

2. Description of Related Art

Cleaning devices that allow for the cleaning of hard surfaces such as, but not limited to, window, walls, counters, floors, mirrors, tiles, tables, and others are known. Some prior art cleaning devices are also known to include cleaning fluid spraying systems—that allow the user to spray cleaning fluid onto the surface to be cleaned.

However, it has been determined by the present disclosure that such prior art cleaning devices are less than optimal. For example, prior art cleaning devices typically require the user to manually refill the cleaning fluid reservoir, providing the opportunity for the user to inadvertently spill or come into contact with the cleaning fluid. Additionally, prior art cleaning devices are often limited to a single cleaning task—namely are not adjustable in one or more of the shape and/or size of the cleaning head and/or the length of the device.

Accordingly, there is a need for improved hard surface cleaning devices that improve upon, overcome, alleviate, and/or mitigate the deleterious effects and inefficiencies of prior art devices.

SUMMARY

A cleaning device is provided that includes a housing, a cleaning head, a flexible pouch, a cleaning element, and a spray nozzle. The housing defines an internal cavity having a power source in selective electrical communication with a pump. The flexible pouch is removably stored in the housing and includes a cleaning fluid therein. The pouch forms a fluid and air tight connection with an inlet of the pump. The cleaning element is connected to the cleaning head and has a second spray opening in registration with the first spray opening. The spray nozzle is in fluid communication with an outlet of the pump. The spray nozzle is positioned on the cleaning head so as to spray the cleaning fluid from the flexible pouch through the first spray opening onto a surface being cleaned.

The above-described and other features and advantages of the present disclosure will be appreciated and understood by those skilled in the art from the following detailed description, drawings, and appended claims.

DETAILED DESCRIPTION

Figure 1:
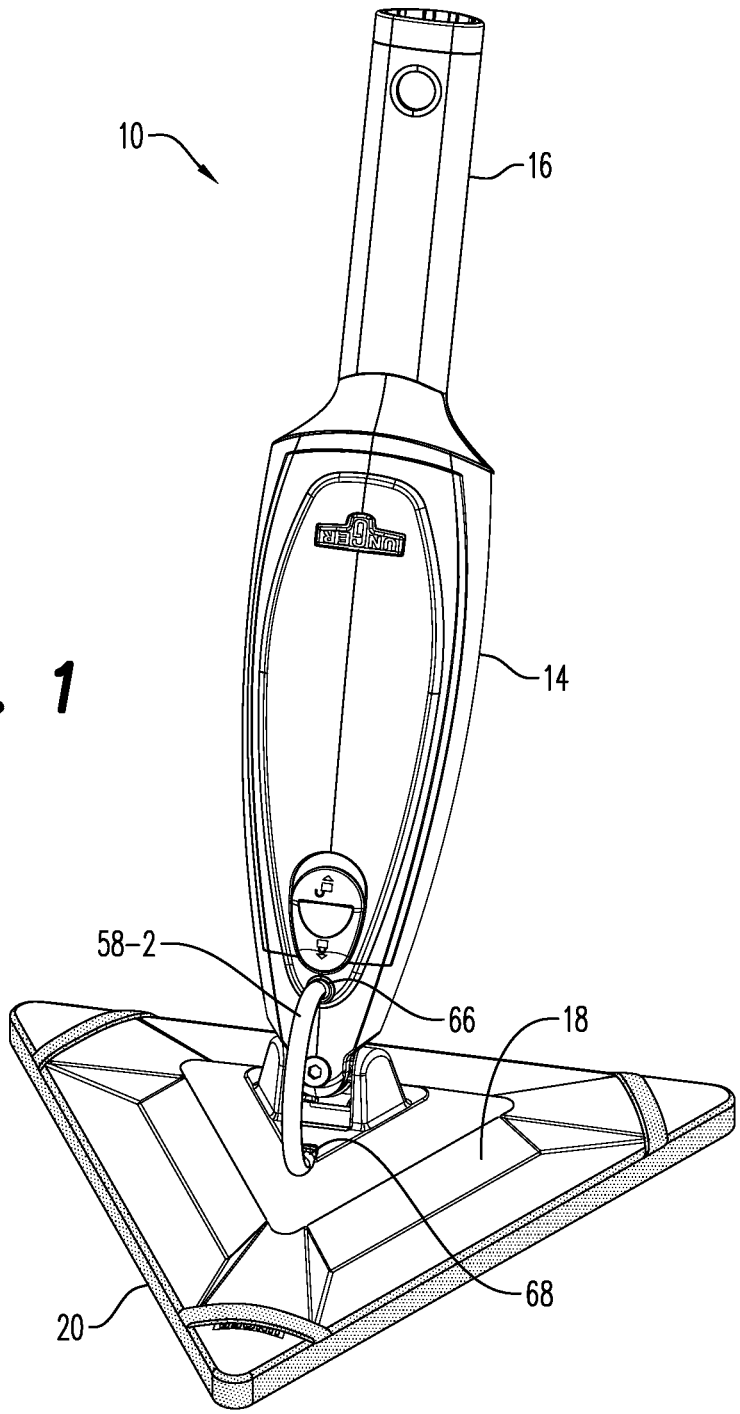
FIG. 1 is a front perspective view of an exemplary embodiment of a cleaning device according to the present disclosure.
Figure 2:
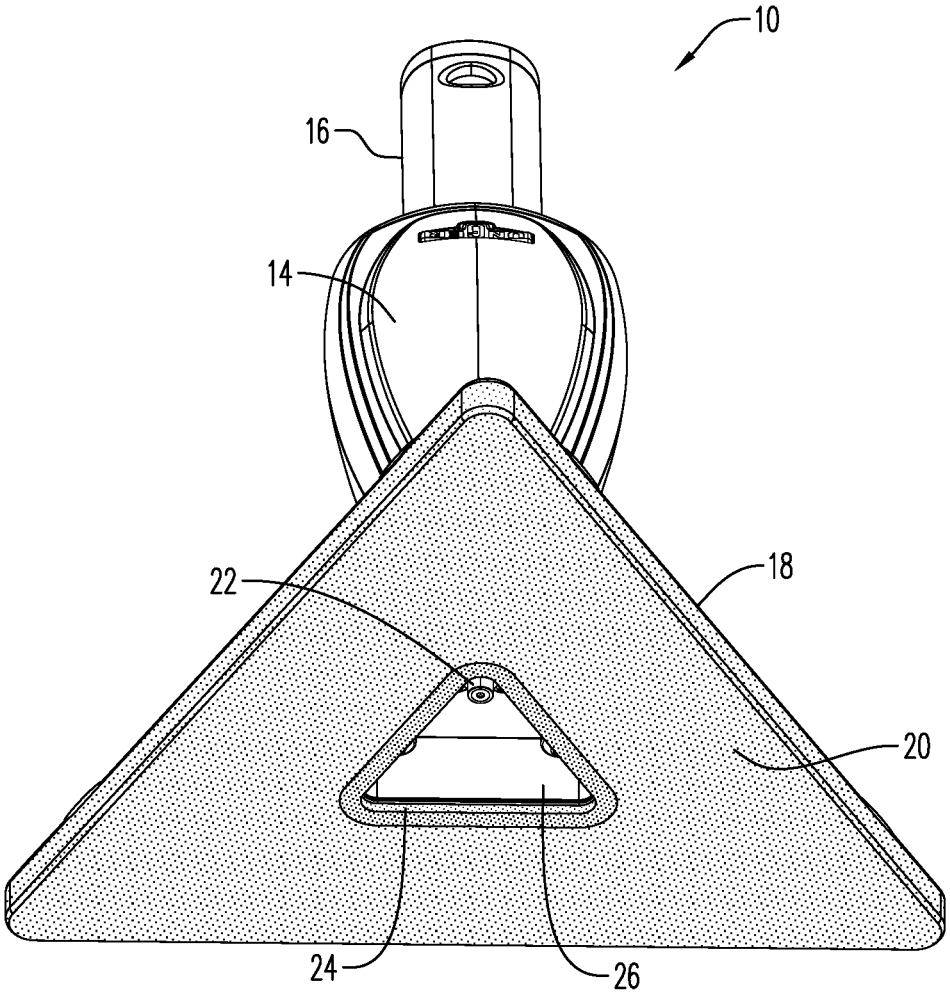
FIG. 2 is a rear perspective view of the cleaning device of FIG. 1.
Figure 3:
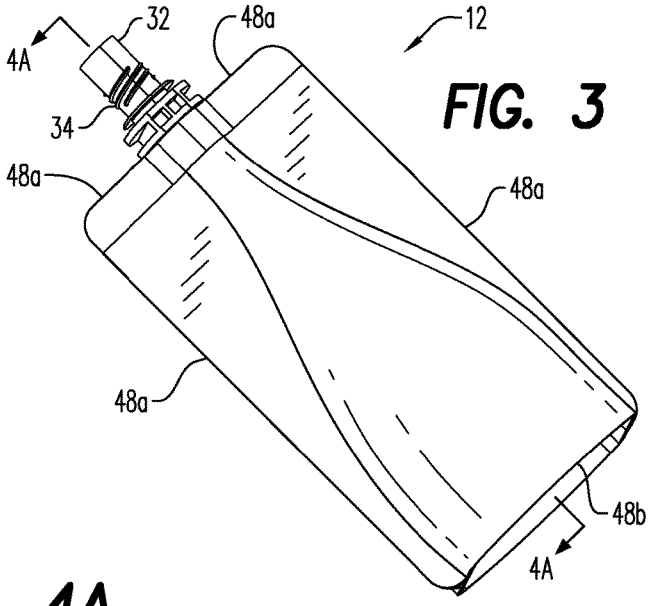
FIG. 3 is a side view of an exemplary embodiment of a cleaning fluid pouch for use with the device of FIG. 1.
Figure 4A:
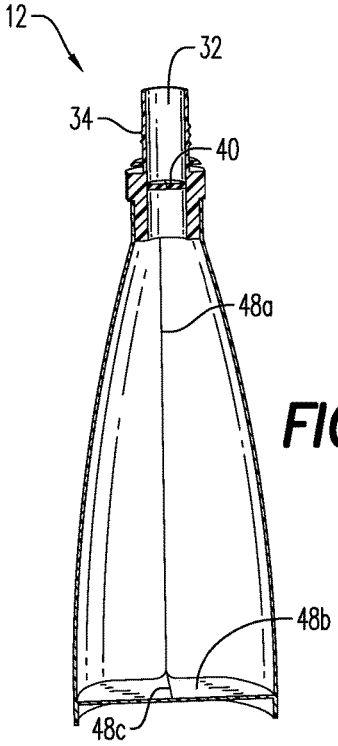
FIG. 4A is a section view of the cleaning fluid pouch of FIG. 3 taken along line 4A-4A.
Figure 4B:
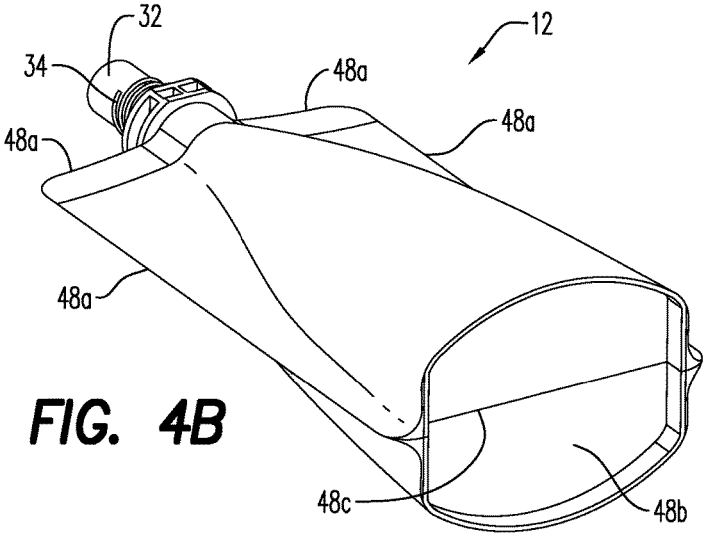
FIG. 4B is a bottom view of the cleaning fluid pouch of FIG. 3.
Figure 5:
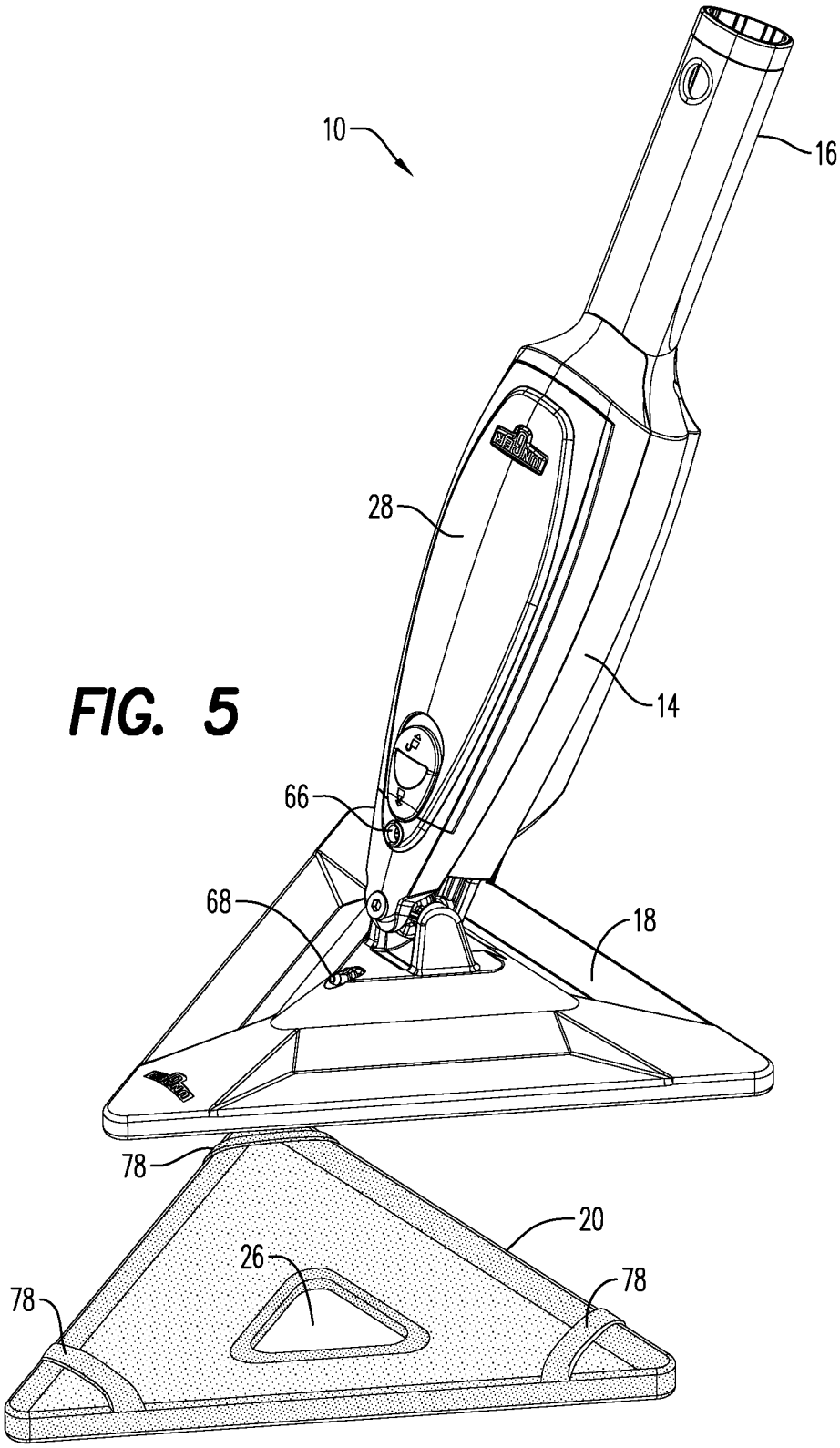
FIG. 5 is another front rear perspective view of the cleaning device of FIG. 1 illustrating the removability of the cleaning element.
Figure 6:
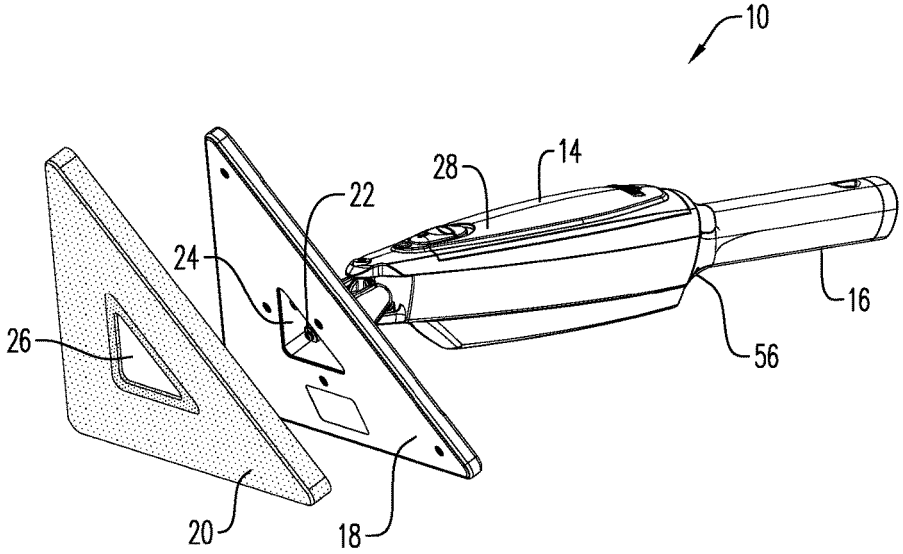
FIG. 6 is a bottom perspective view of the cleaning device of FIG. 1 illustrating the removability of the cleaning element.
Figure 7:
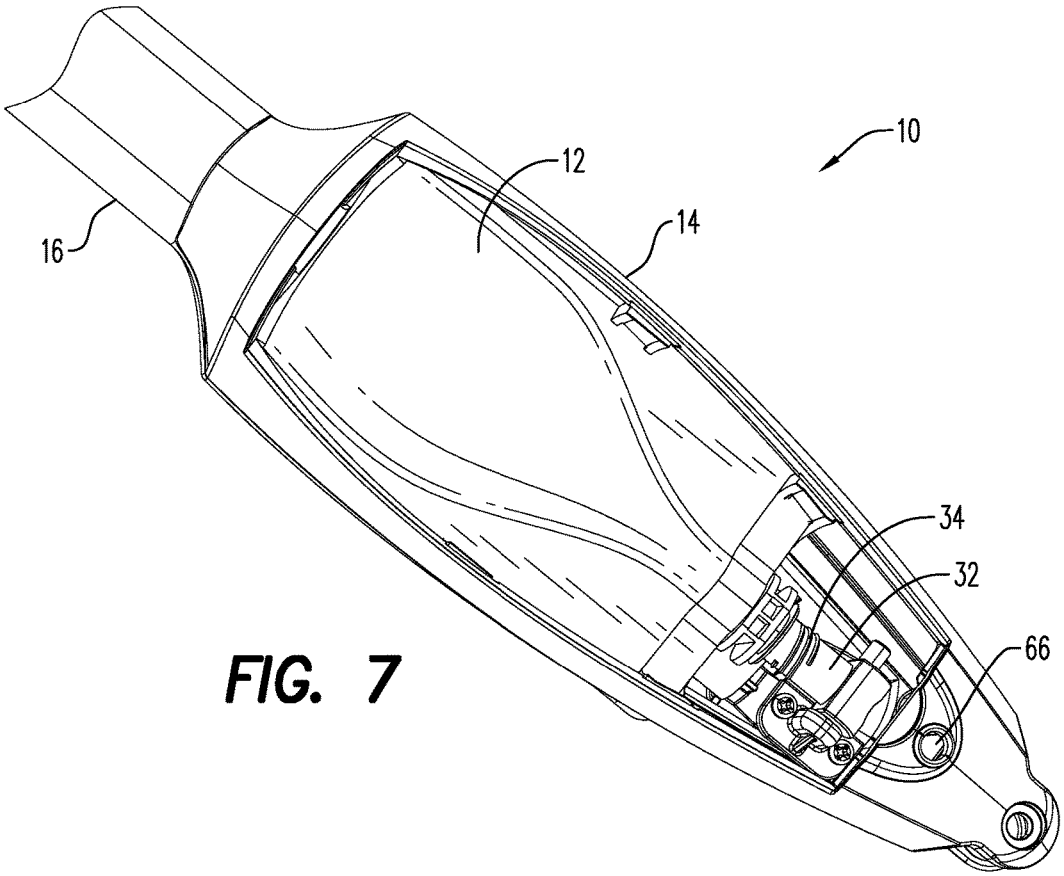
FIG. 7 is a top perspective view of the cleaning device of FIG. 1 having a housing cover removed to illustrate the cleaning pouch installed in an internal cavity.
Figure 8:
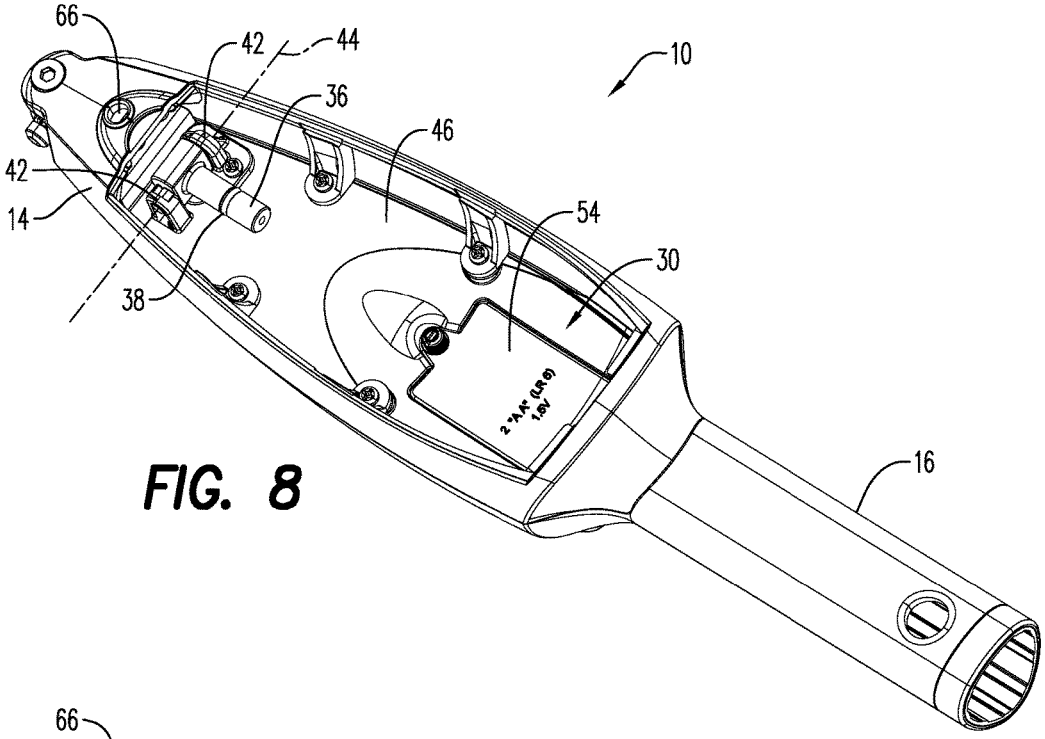
FIG. 8 is a top perspective view of the cleaning device of FIG. 1 having the housing cover and cleaning pouch removed.
Figure 9:
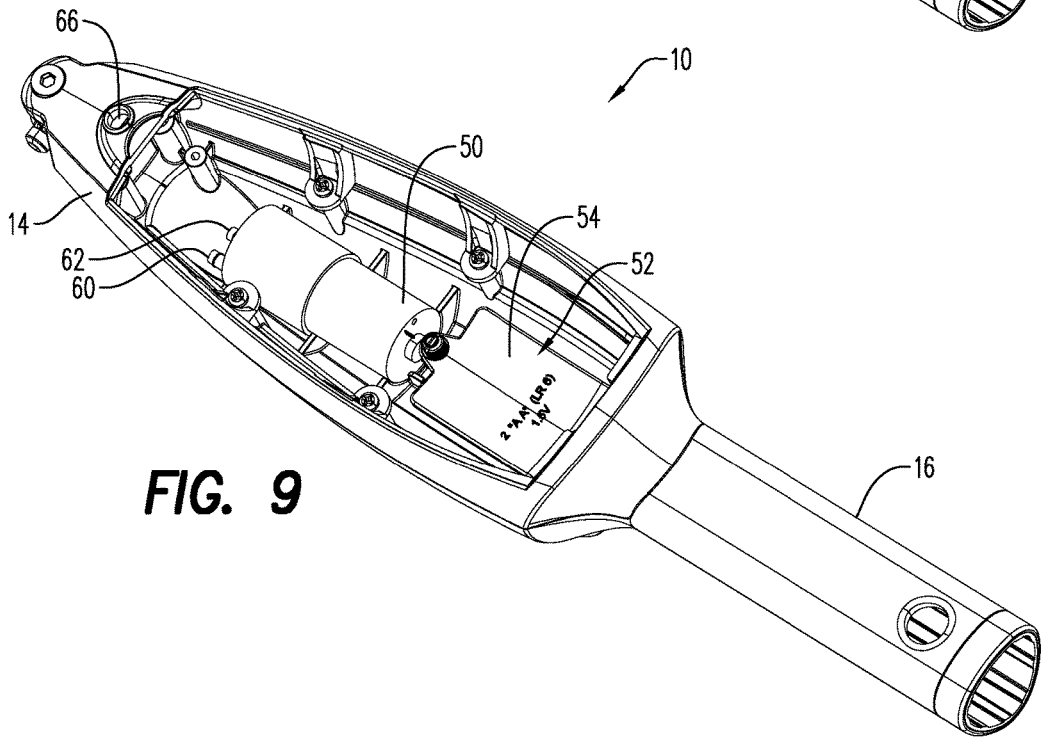
FIG. 9 is a top perspective view of the cleaning device of FIG. 1 illustrating the internal cavity.
Figure 10:
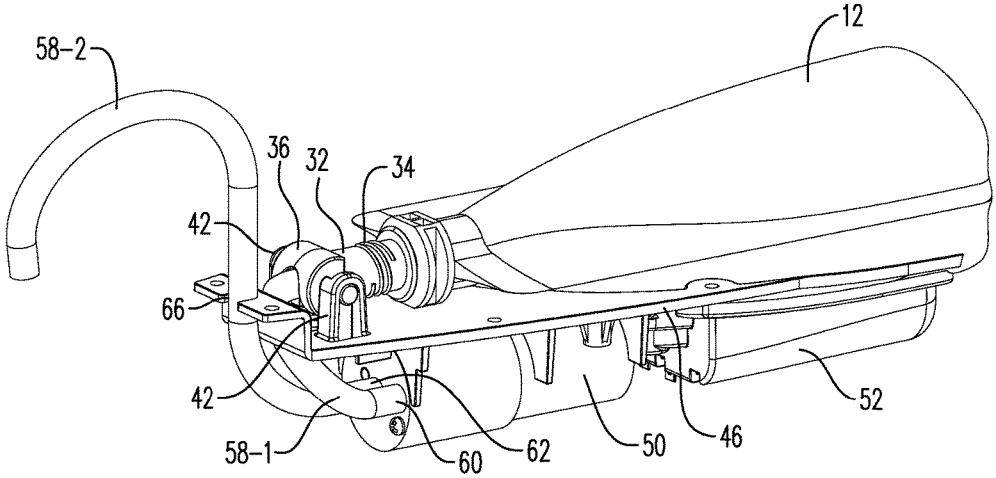
FIG. 10 is a top perspective view of the pump system of FIG. 9.
Figure 11:
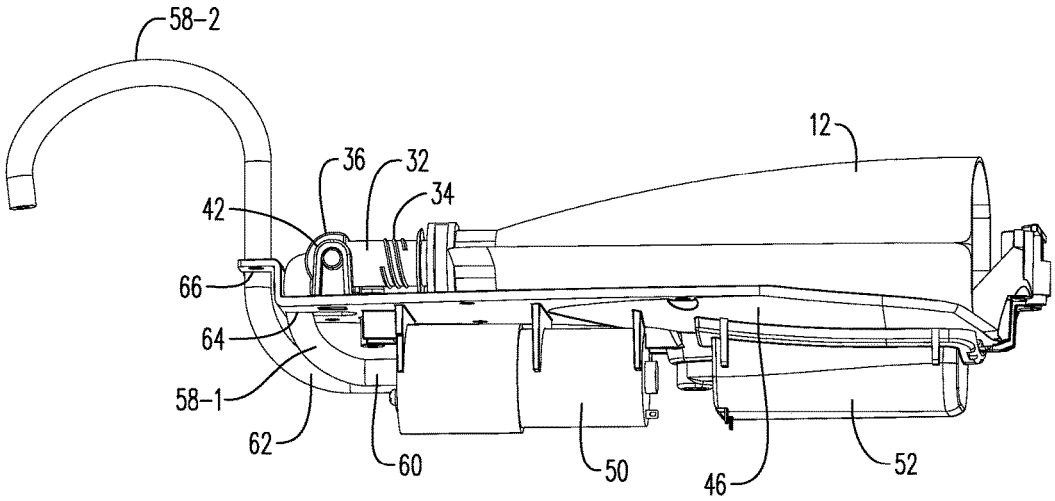
FIG. 11 is a side perspective view of the pump system of FIG. 9.
Figure 12:
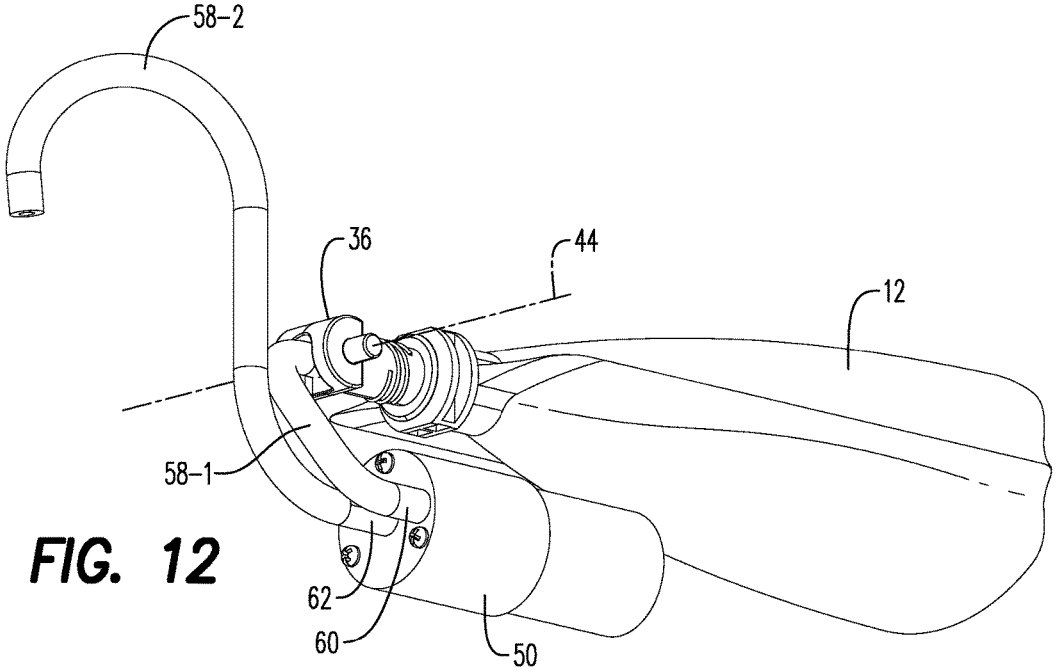
FIG. 12 is a front perspective view of portions of the pump system of FIG. 9.
Figure 13:
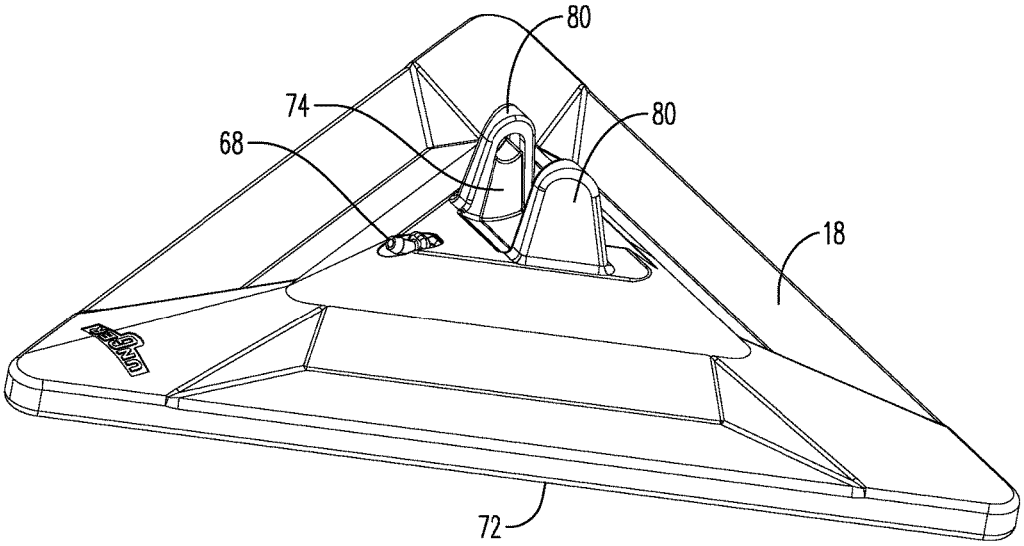
FIG. 13 is a top perspective view of an exemplary embodiment of a cleaning head according to the present disclosure.
Figure 14:
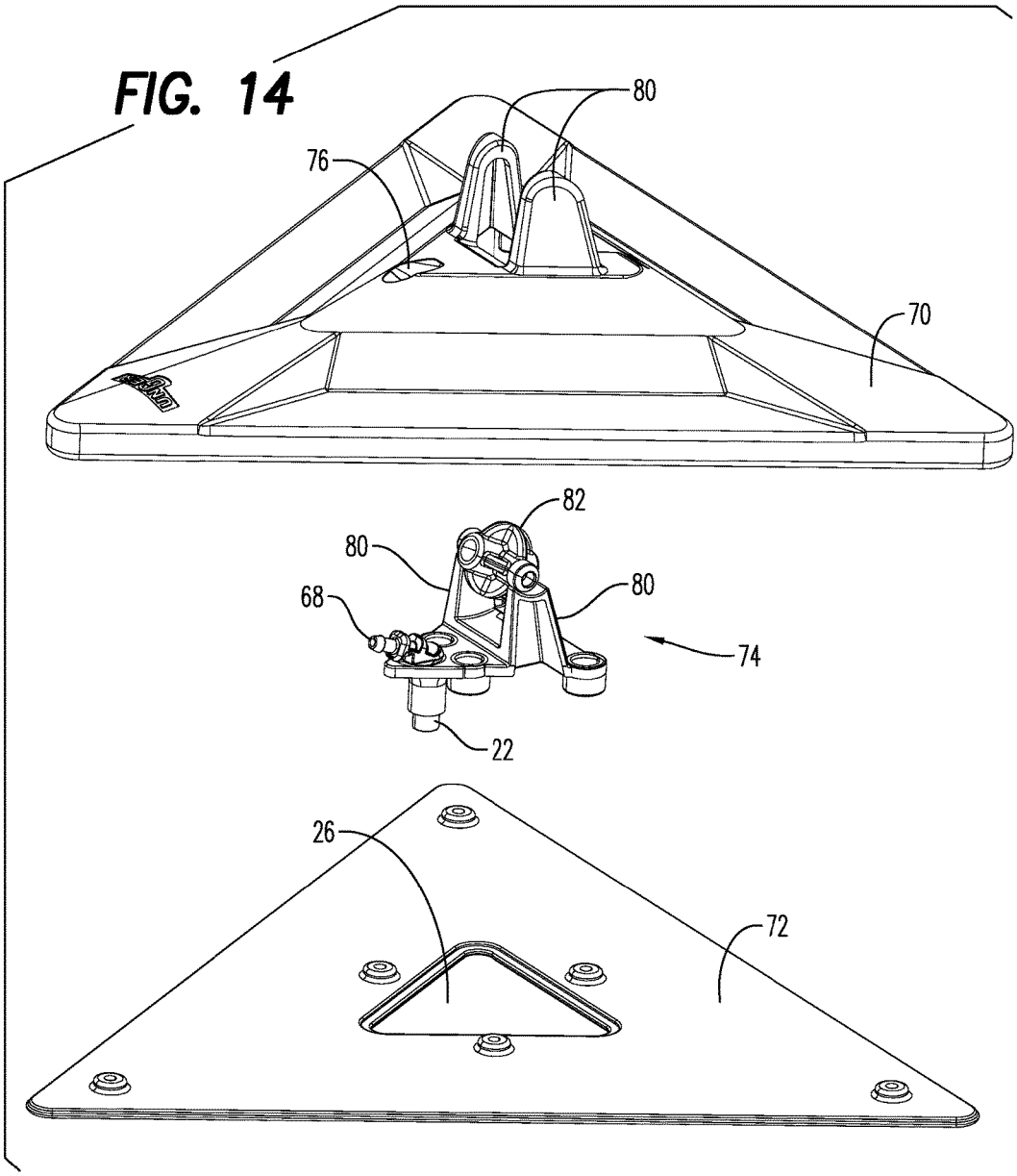
FIG. 14 is a top perspective, exploded view of the cleaning head of FIG. 13.

Referring to the drawings and in particular to FIGS. 1-3, an exemplary embodiment of a cleaning device according to the present disclosure is shown and is generally referred to by reference numeral 10 and an exemplary embodiment of a cleaning fluid pouch according to the present disclosure is shown and is generally referred to by reference numeral 12.

Device 10 includes a main housing 14 having a handle 16 depending therefrom. Device 10 also includes a cleaning head 18 having a cleaning element 20 disposed thereon. As will be described in more detail below, device 10 is configured to removably receive pouch 12 within housing 14.

Additionally, device 10 is configured to pump fluid from pouch 12 to one or more spray nozzles 22 (one shown) directly onto the surface being cleaned. Here, cleaning head 18 and cleaning element 20 each include central openings 24, 26, respectively that are in alignment or registration with one another so that spray nozzles 22 spray the cleaning fluid through the openings 24, 26 onto the surface being cleaned. Thus, nozzles 22 are protected from damage that may occur during use.

Moreover and when device 10 is placed with cleaning element 20 against the surface being cleaned, any spray of the cleaning fluid is captured or trapped within head 18 due to the position of nozzles 22. Without wishing to be bound by any particular theory, it is believed that device 10—by capturing the spray of the cleaning fluid between head 18 and the surface being cleaned—prevents airborne cleaning fluid from being present in the air near the user's mouth and nose, particularly as the device is held at or above head level while cleaning windows, mirrors, and the like. In the example where device 10 is used in window cleaning, the cleaning fluid often includes chemicals with a viscosity low enough to be formed into a mist—namely atomized or formed into an aerosol—by the spraying through nozzles 22. When prior art window cleaning devices are used to clean items at or above the user's mouth and nose, the atomized cleaning fluid can disadvantageously pass through the breathing space—an outcome that device 10 prevents by constraining the spray of the cleaning fluid between head 18 and the surface being cleaned.

Figure 15:
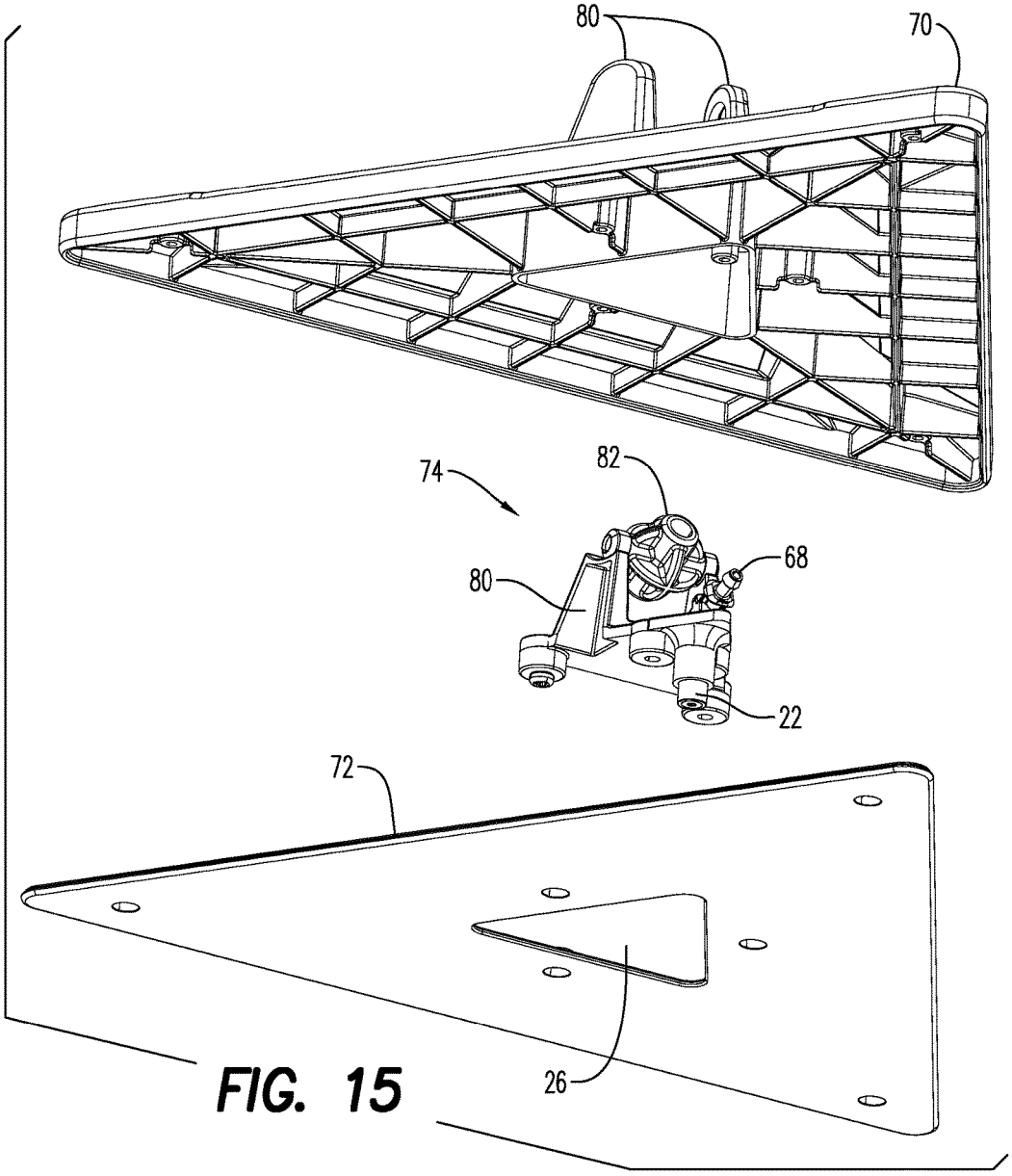
FIG. 15 is a bottom perspective, exploded view of the cleaning head of FIG. 13.
Figure 15A:
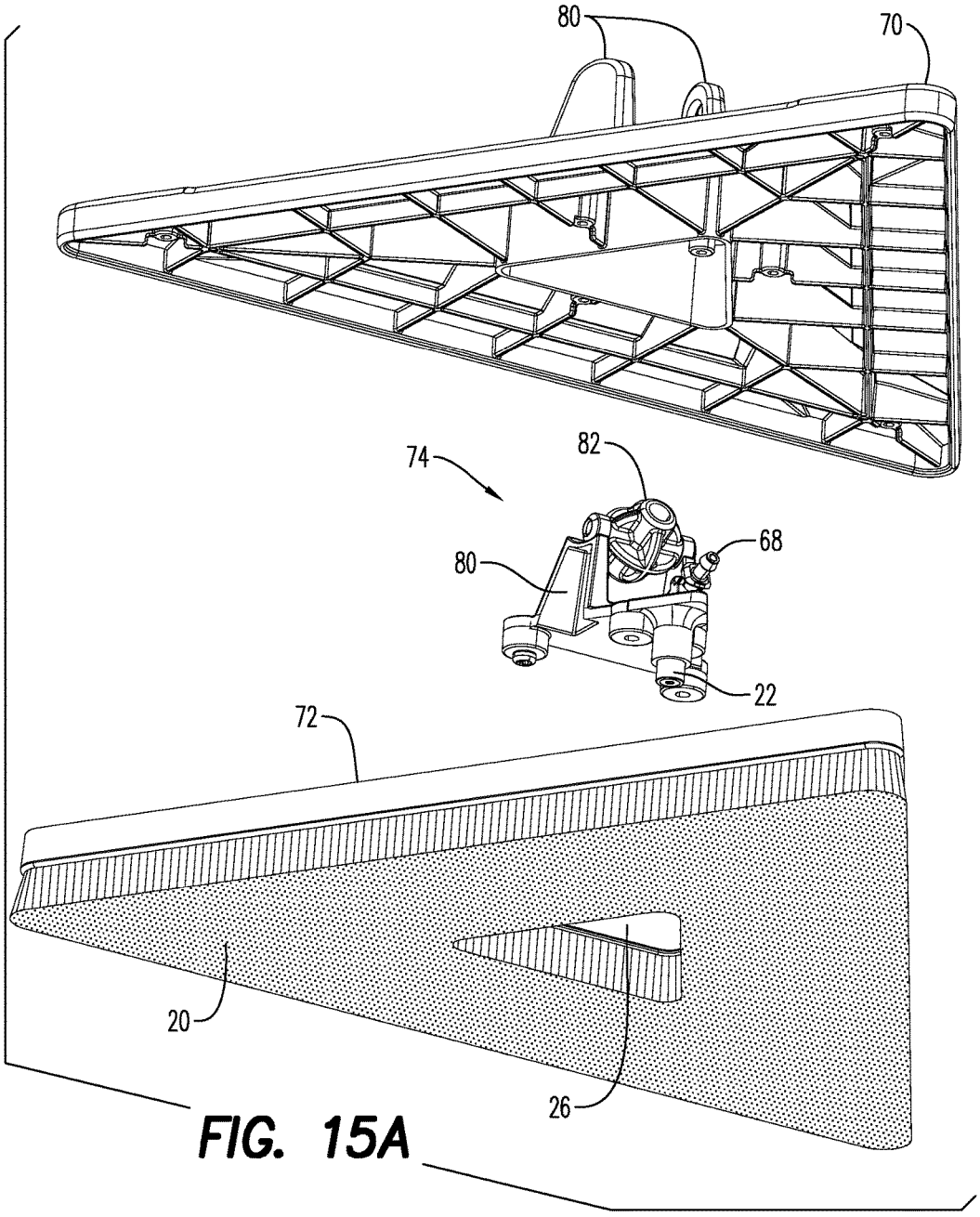
FIG. 15A is a bottom perspective, exploded view of an alternate embodiment of the cleaning head of FIG. 13.

In the embodiment illustrated, cleaning element 20 is illustrated as a cleaning pad made of, for example, microfiber, cotton, wool, non-woven, or any combinations thereof. Of course, it is contemplated by the present disclosure for cleaning element 20 to be any desired element such as, but not limited to, brush bristles as shown in FIG. 15A, squeegee, scraper, or any other cleaning element and combinations thereof.

In this manner, device 10 and pouch 12 increase the ease of use during the cleaning of various hard surfaces by, for example, providing improved ergonomics, location of switches, and/or maneuverability. In some embodiments, device 10 and pouch 12 advantageously provide sufficient weight at cleaning head 18 so as to assist the user in applying cleaning element 20 to the surface being cleaned, which assists the operator to clean the surface.

Device 10 and pouch 12 are described in more detail with simultaneous reference to FIGS. 1-12.

Housing 14 includes a removable cover 28 disposed over an internal cavity 30 so as to allow the user to selectively open and close the cavity. Cavity 30 is configured to removably receive pouch 12 therein. Pouch 12 is formed of a material having sufficient flexibility to conform to the space within cavity 30. For example, pouch 12 is preferably formed of a foil or polymer material.

It should be recognized that pouch 12 is described above by way of example only as a flexible pouch. Of course, it is contemplated by the present disclosure for pouch 12 to form a liner of a fluid container, where the liner collapses within the rigid container during use.

Pouch 12 includes a connection port 32 that allows the pouch to form a releasable fluid and air tight connection with device 10. Connection port 32 includes a closure member 34, illustrated as an external thread, which removably receives a cap or closure (not shown) to close the pouch before use and/or between uses. In this manner, pouch 12 is easily accessible and replaceable.

Device 10 includes a pouch port 36 that can be removably received in connection port 32 of pouch 12 to place the pouch in fluid communication with the inlet port. Thus, a user can remove the cap from closure member 34 of pouch 12 and insert pouch port 36 into connection port 32 to form a fluid and air tight connection. In some embodiments inlet port 36 can include an o-ring 38 or other seal member to improve or enhance the seal between pouch 12 and pouch port 36.

Preferably, pouch 12 can include a slit valve 40 that selectively opens upon application of a negative pressure on the pouch by the pump within device 10 and closes, under its own resilience after the pump is turned off. In this manner, device 10 with pouch 12 installed therein forms a fluid tight connection that prevents, or at least minimizes, leakage of cleaning fluid from pouch when the device is stored or not in use and/or when the pouch is removed from the device. Thus, pouch 12 and pouch port 36 are configured so that the pouch port, when inserted into the pouch, does not pass through valve 40.

In the illustrated embodiment, pouch port 36 is secured to housing 14 by one or more upstanding arms 42 so as to pivot about an axis 44. It has been found by the present disclosure that pivoting of pouch port 36 upward out of cavity 30 can assist the user to connect and disconnect pouch 12 to and from housing 14. Specifically, the user can pivot pouch port 36 to face out of cavity 30 during connection of pouch 12, then once connected, can pivot the pouch port back into the cavity to assist in storing the pouch in the cavity.

Pouch 12 can be held in position in cavity 30 by—for example—the friction between connection and pouch ports 32, 36. Of course, it is contemplated by the present disclosure for device 10 to secure pouch 12 in cavity 30 by any desired method.

Cavity 30 includes a plate 46 that separates pouch 12 from one or more electrical components—namely pump 50 and power source 52 such as a battery. In order to allow replacement of the power source 52, plate 46 can include a separate removable cover 54, which in some embodiments can be provided with a seal or o-ring (not shown) to eliminate or at least mitigate leakage of fluids into the power source.

Pump 50 and power source 52 are in selective electrical communication with one another by way of an activation button 56 defined on housing 14. In this manner, the user can—by depressing button 56—place pump 50 in electrical communication with power source 52 to selectively activate the pump.

In some embodiments, device 10 is configured in a manner that minimizes hydraulic resistance so that that size and weight of pump 50 and power source 52 can be minimized. The hydraulic resistance of device 10 can be minimized by, for example, allowing pouch 12 to collapse as pump 50 draws fluid from the pouch. Stated another way, the fluid and air tight connection between connection and pouch ports 32, 36 results in pouch 12 collapsing as fluid is withdrawn from the pouch.

It should be recognized that device 10 is described by way of example as including pump 50 described in combination with power source 52 as an electric pump. Of course, it is contemplated by the present disclosure for device 10 to find use with a manual pump—that allows the operator to actuate the manual pump via actuation button 56 in the form of a trigger or similar device.

Pouch 12 includes, in some embodiments, an elongated sealed edge 48*a* along the elongated sides and top and a flat bottom 48*b*. In this manner, pouch 12 returns to a substantially flat shape when collapsing as the fluid is withdrawn with flat bottom 48*b* being pulled into pouch 12 along one or more pleats or folds 48*c*. Without wishing to be bound by any particular theory, it is believed that the easy to collapse configuration of pouch 12 assists in providing the minimized hydraulic resistance of device 10.

Additionally, the hydraulic resistance of device 10 can also be minimized by, for example, reducing the number of valves in the fluid path—which is also made possible, at least in part, by the fluid and air tight connection between connection and pouch ports 32, 36. Thus, device 10 has only one valve, namely valve 40, in the fluid path yet still provides a system that eliminates, or at least minimizes, leakage of cleaning fluid from pouch 12 when the device is stored or not in use. Accordingly, device 10, in some embodiments, is configured so that pump 50 is a 3 volt pump and power source 52 is two standard AA batteries.

Pump 50 includes a pump inlet 60 and a pump outlet 62. Device 10 includes a conduit path 58-1 fluidly connecting pump inlet 60 to pouch port 36. Conduit 58-1 between pouch port 36 and pump inlet 60 passes through plate 46 at a first pathway 64.

Device 10 also includes conduit path 58-2 fluidly connecting pump outlet 62 to spray nozzles 22. Conduit path 58-2 between pump outlet 62 passes through plate 46 at a second pathway 66. Specifically, head 12 includes a head inlet 68 to which conduit path 58-2 from pump outlet 62 is fluidly connected.

Head 18 is described in more detail below with respect to FIGS. 13-16, which also provides more detail on the fluid connection between head inlet 68 and spray nozzles 22.

Head 18 includes an upper cover 70, a lower cover 72, and a support member 74 positioned between the covers. Support member 74 includes spray nozzles 22 and head inlet 68 fluidly communicating with one another. Upper cover 70 includes a port 76 through which head inlet 68 extends. Similarly, lower cover 72 includes central opening 26 through which spray nozzles 22 are directed. Preferably, support member 74 is configured so that nozzles 22 are recessed with respect to the bottom surface of head 18, which allows the head to prevent the nozzles from being damaged during use.

It should be recognized that device 10 is disclosed by way of example only having central opening 26 in lower cover 72 and having nozzles 22 recessed therein. Of course, it is contemplated by the present disclosure for lower cover 72 to have one or more openings 26 through which nozzles 22 are positioned in a manner to be substantial even or flush with the bottom surface of the lower cover. Moreover, it is contemplated by the present disclosure for lower cover 72 to have one or more openings 26 through which nozzles 22 are positioned to extend from the bottom surface of the lower cover less by a distance less than a thickness of the cleaning element 20. In these embodiments, the thickness of cleaning element 20 provides an offset between nozzles 22 and the surface being cleaned.

Support member 74 and upper cover 70 together form a pair of supports 80, which receive a pivot member 82 therebetween to allow head 18 to be secured to housing 14—and preferably removably secured to the housing. Pivot member 82 is secured between support member 74 and upper cover 70 so as to pivot or rotate about a first axis 84.

Cleaning element 20 can be removably secured to cleaning head 18 in any desired manner. In some embodiments, cleaning element 20 can include one or more connectors 78 for removably securing the cleaning element to head 18. For example, cleaning element 20 is illustrated having three connectors 78 one at each corner of the triangular shape of head 18. In some embodiments, one or more of connectors 78 can be elastic so as to allow cleaning element 20 to be secured to head 18. In other embodiments, one or more of connectors 78 can be hook-and-loop type fasteners so as to allow cleaning element 20 to be secured to head 18. Of course, it is contemplated by the present disclosure for connectors 78 to have any desired configuration sufficient to removably secure cleaning element 20 to cleaning head 18.

Figure 16:
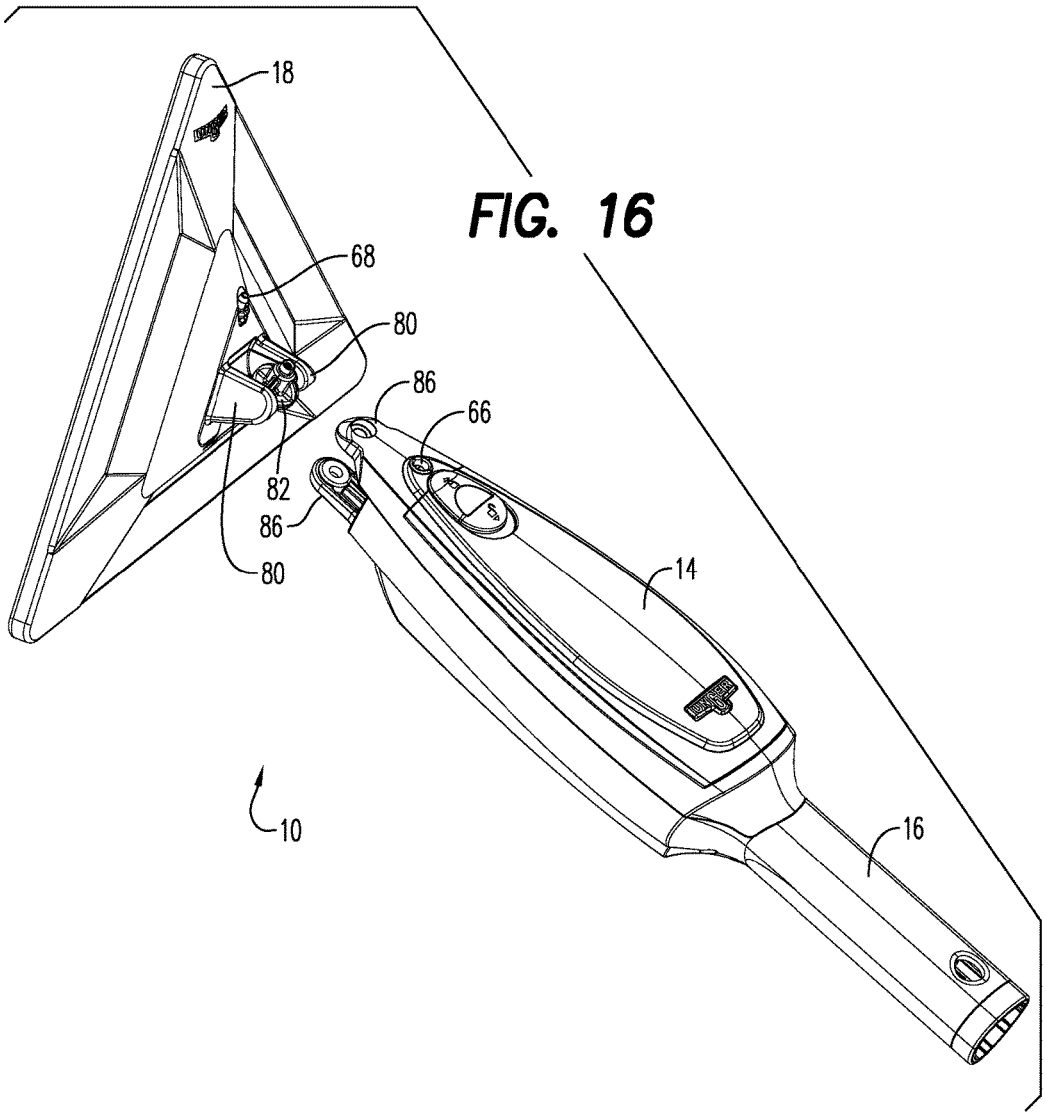
FIG. 16 is a top perspective view of the cleaning device of FIG. 1 having the cleaning head shown in a removed position.
Figure 17:
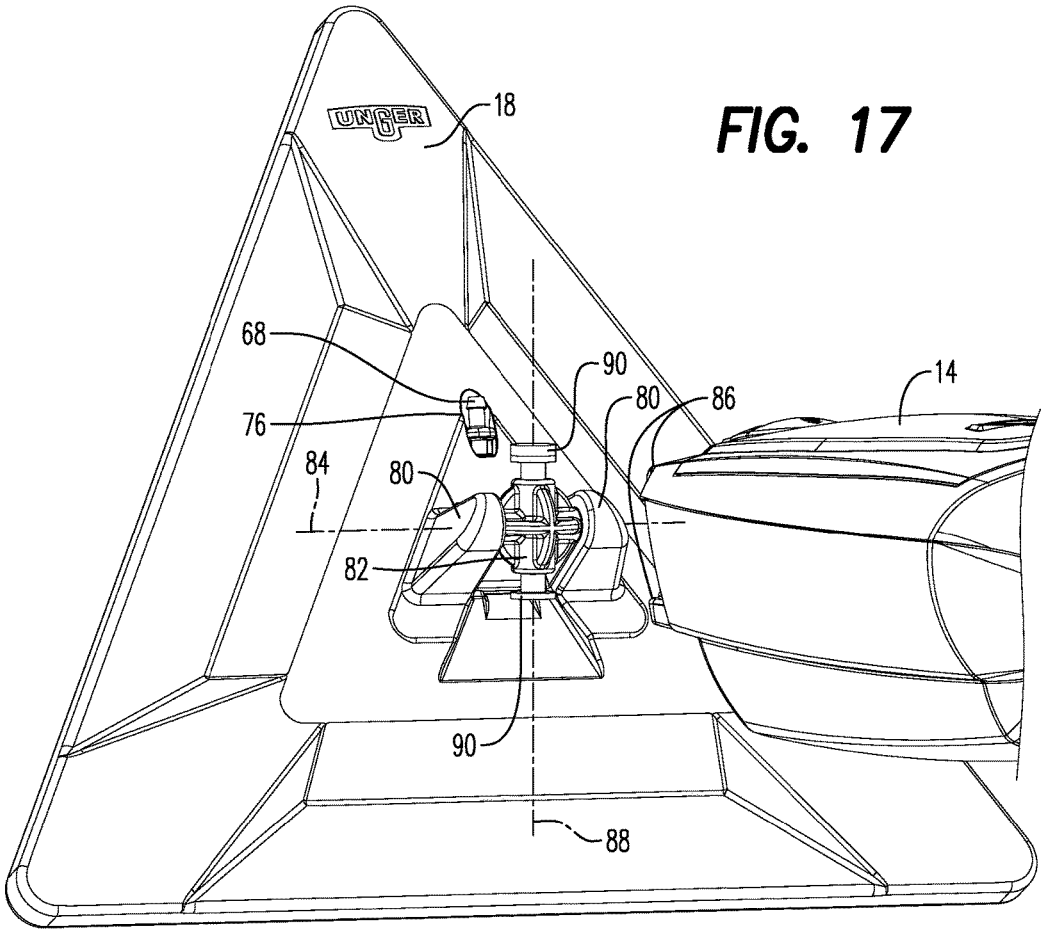
FIG. 17 is an enlarged view of the cleaning device of FIG. 16 having the cleaning head shown in the removed position.
Figure 18:
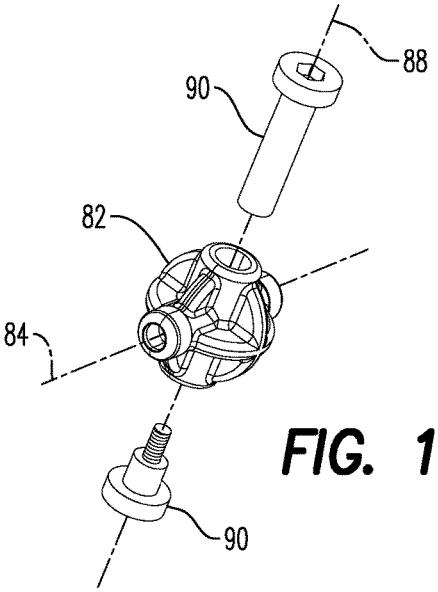
FIG. 18 is an enlarged, exploded view of a pivot member shown in FIG. 16.

The interconnection of housing 16 and head 18 are described in more detail with reference to FIGS. 16-18. Here, housing 16 includes a pair of arms 86 depending therefrom. Pivot member 82 is secured to arms 86 so as to pivot or rotate about a second axis 88 by a connector 90. In this manner, device 10 is configured for rotation about first axis 84 by 160 degrees and about second axis 86 by 180 degrees.

Head 18 can be removed from pivot member 82 and, thus from device 10, by removing connector 90 from the pivot member. In this manner, device 10 is configured to allow the user to replace head 18 or to use heads having different shapes, sizes, and/or configurations. In the illustrated embodiment, connector 90 is shown as a shoulder bolt, which is believed to provide increased structural rigidity to pivot member 82.

Of course, it is also contemplated by the present disclosure for head 18 itself to be configured to allow the user to replace portions of the head with portions having different configurations such as shown in FIG. 15A. Here, lower cover 72 is illustrated being removably received on upper cover 70. Thus in this embodiment, the user can replace one lower cover 72—such as that of FIG. 15 that receives a cleaning cloth as cleaning element 20—with a different lower cover 72—such as that of FIG. 15A that includes a different cleaning element 20, namely brush bristles.

Additionally, it is contemplated by the present disclosure for device 10 to include a scrubbing area such as that disclosed in Applicant's commonly owned U.S. Pat. No. 7,779,501 and/or to include feedback between the different cleaning states as disclosed in Applicant's commonly owned U.S. application Ser. No. 14/668,535, the entire contents of which are incorporated by reference herein.

Figure 19:
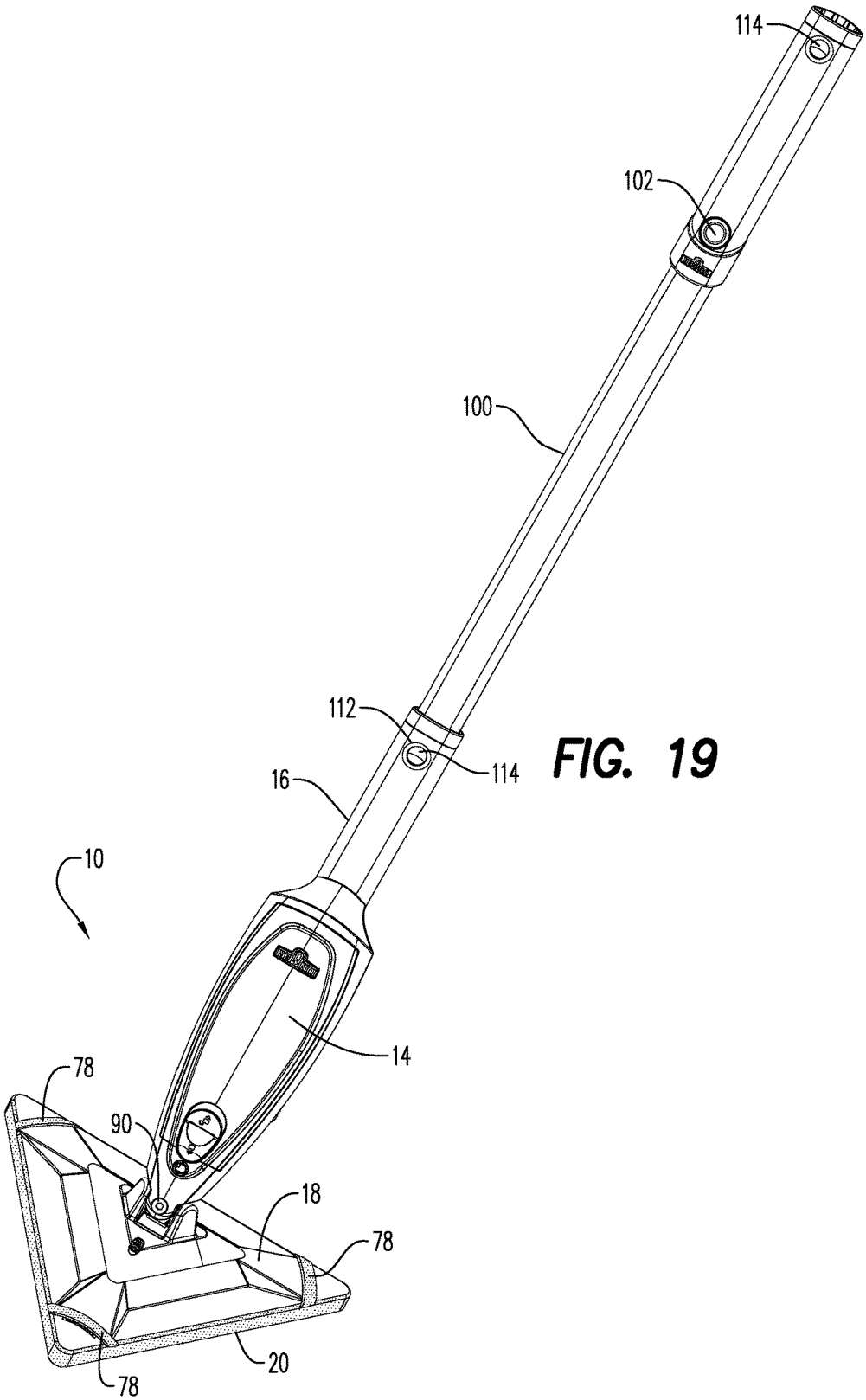
FIG. 19 is a top perspective view of the cleaning device of FIG. 1 having a first extension pole secured thereto.
Figure 20:
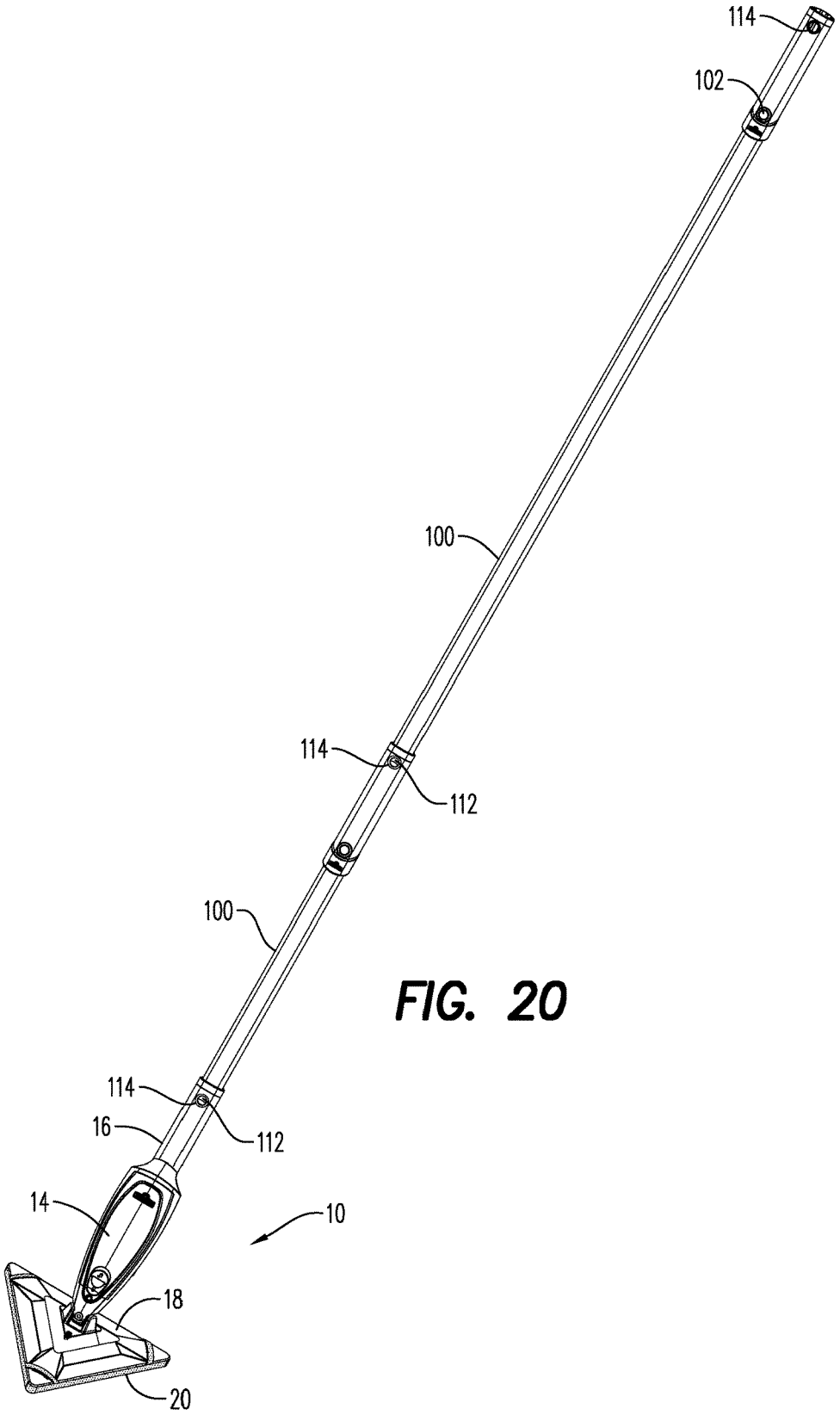
FIG. 20 is a top perspective view of the cleaning device of FIG. 1 having a first extension pole and a second extension pole secured thereto.
Figure 21:
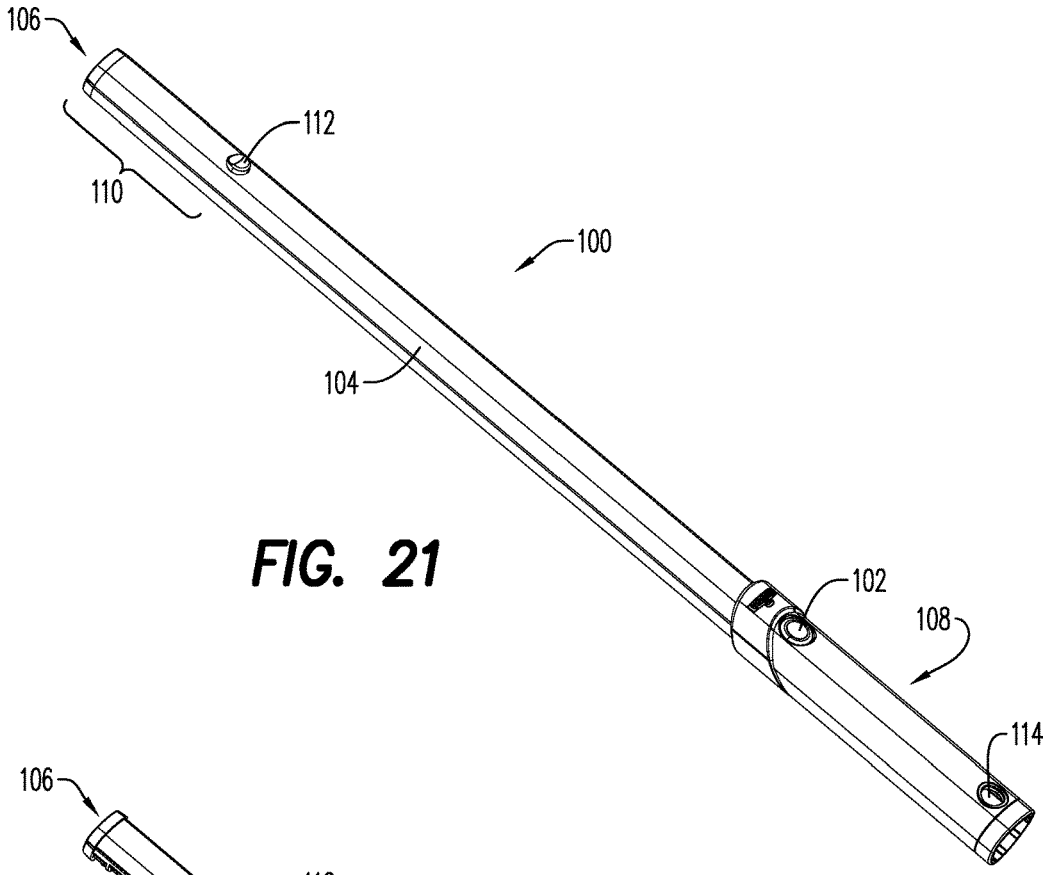
FIG. 21 is a top perspective view of an exemplary embodiment of an extension pole according to the present disclosure.
Figure 22:
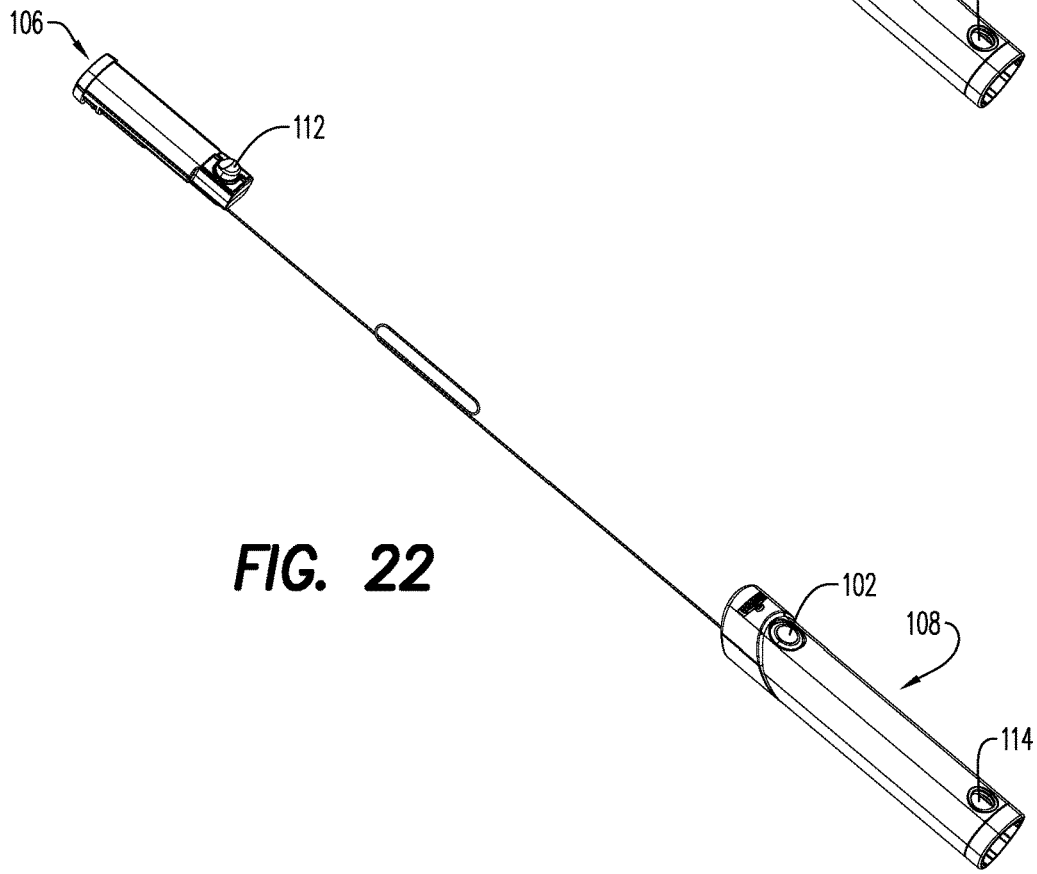
FIG. 22 is a top perspective view of the extension pole of FIG. 21 having various components omitted for clarity.
Figure 23:
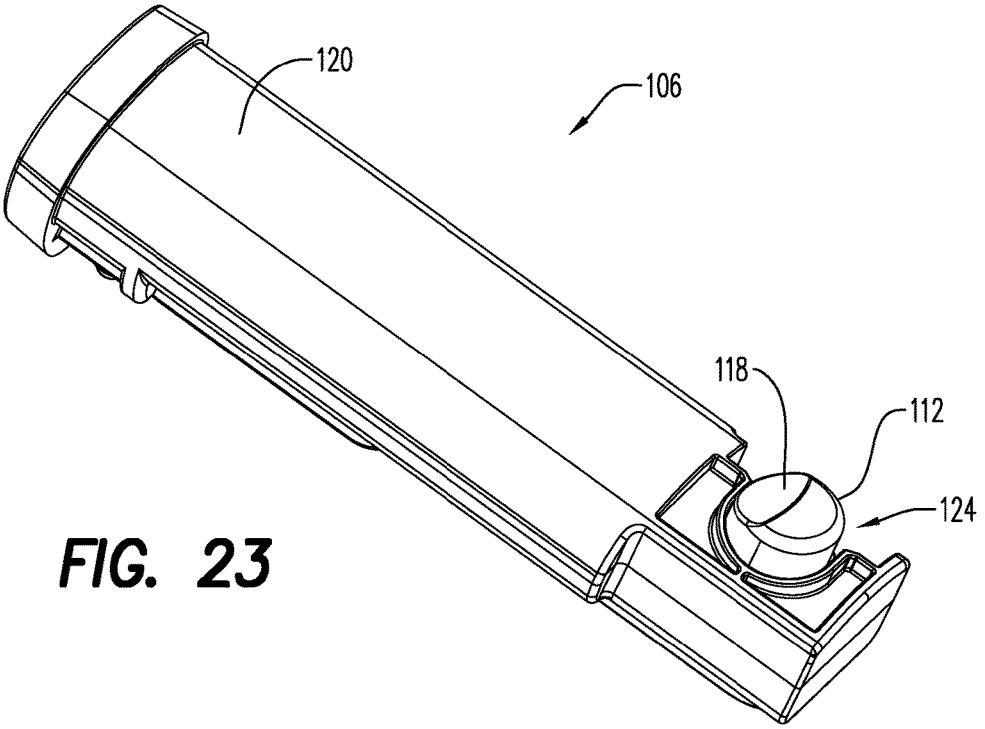
FIG. 23 is a top perspective view of an exemplary embodiment of a first pole connection assembly according to the present disclosure.
Figure 24:
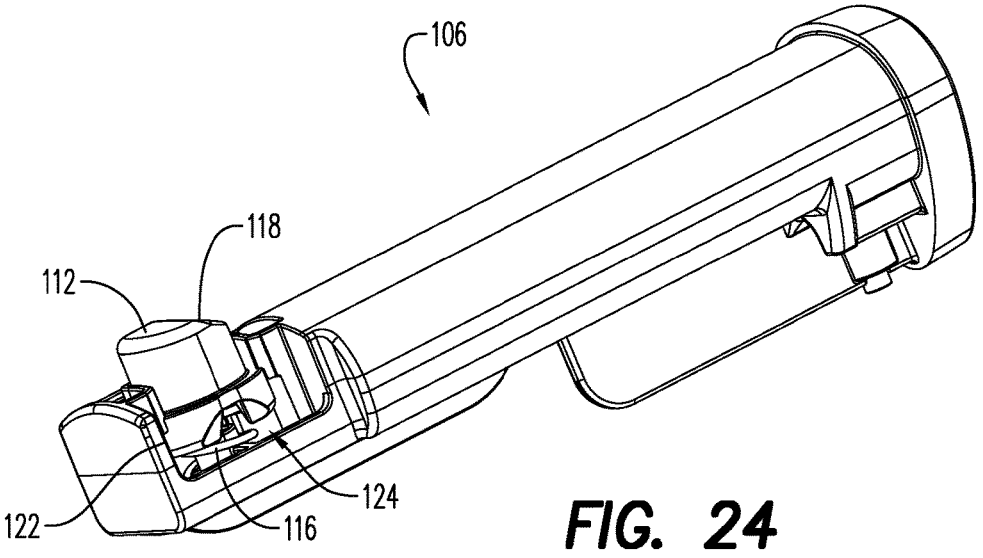
FIG. 24 is a side perspective view of the first pole connection assembly of FIG. 23.
Figure 25:
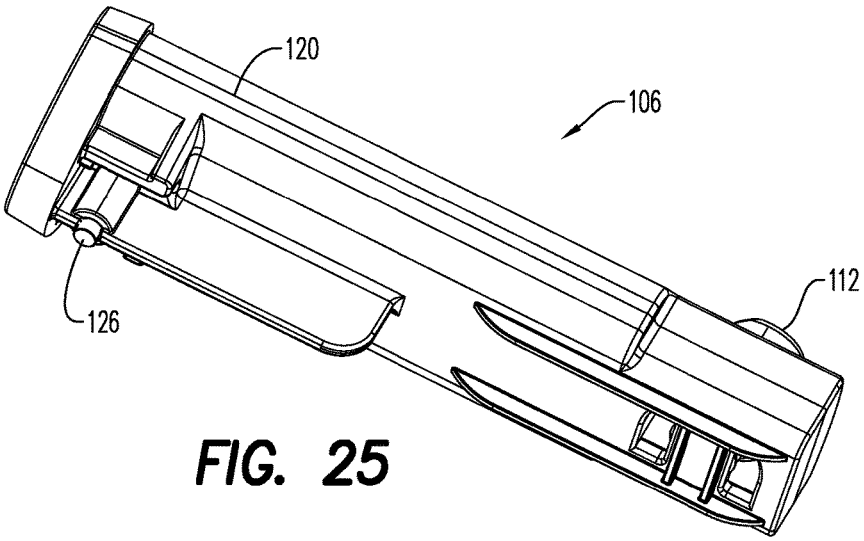
FIG. 25 is a bottom perspective view of the first pole connection assembly of FIG. 23.
Figure 26:
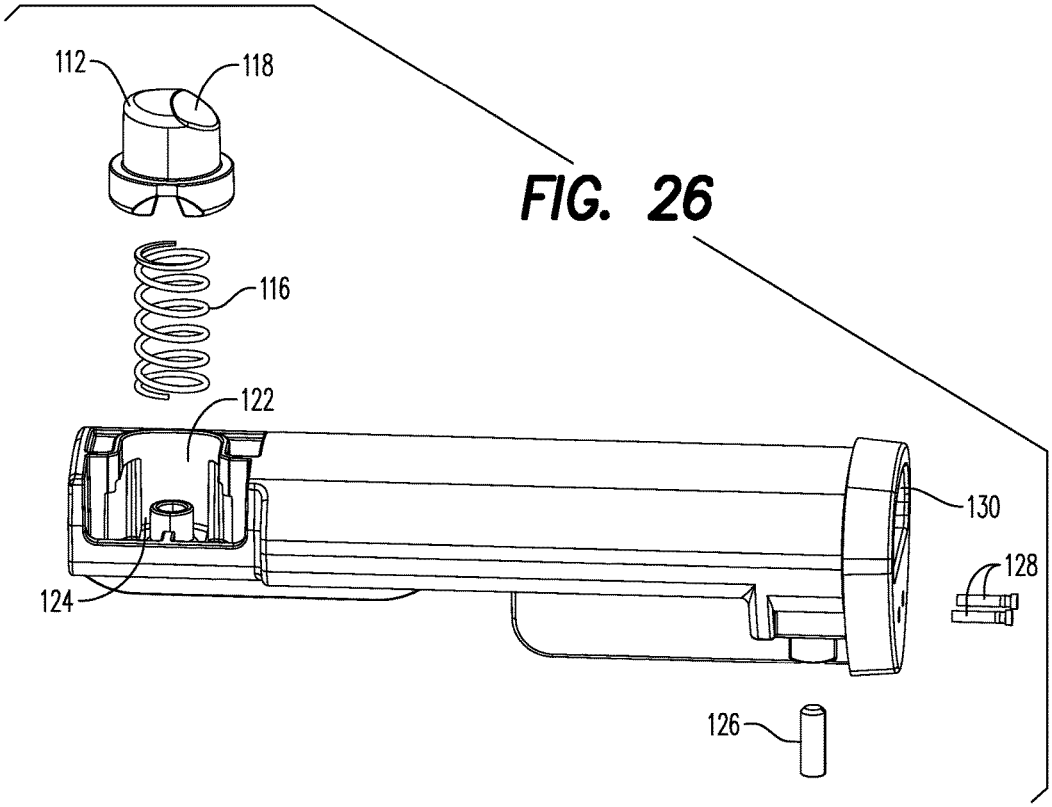
FIG. 26 is a side perspective, exploded view of the first pole connection assembly of FIG. 23.
Figure 27:
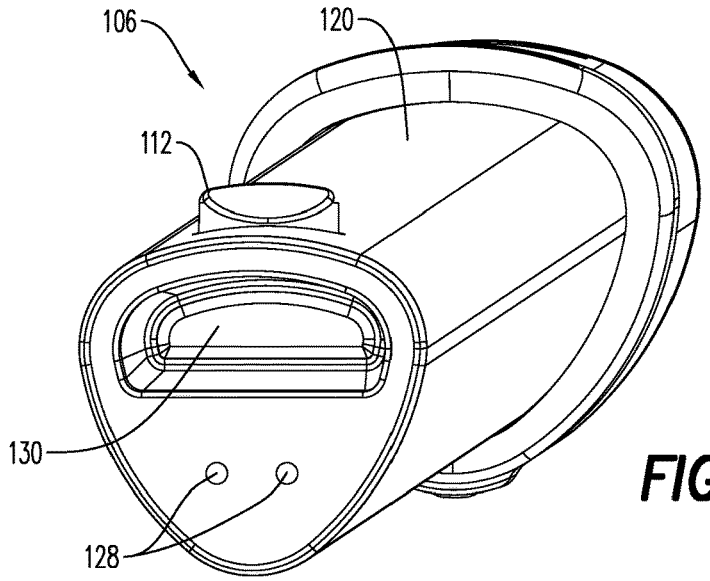
FIG. 27 is an end view of the first pole connection assembly of FIG. 23.
Figure 28:
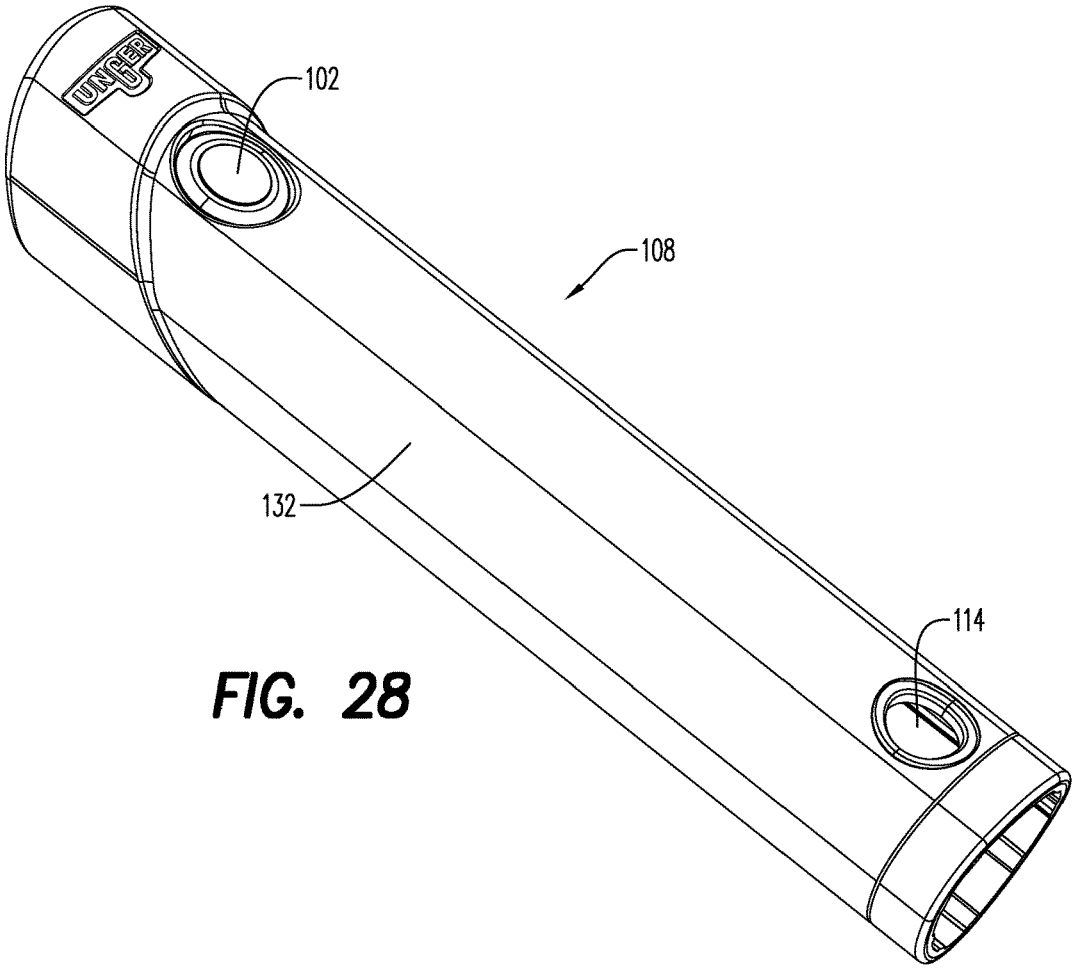
FIG. 28 is a top perspective view of an exemplary embodiment of a second pole connection assembly according to the present disclosure.
Figure 29:
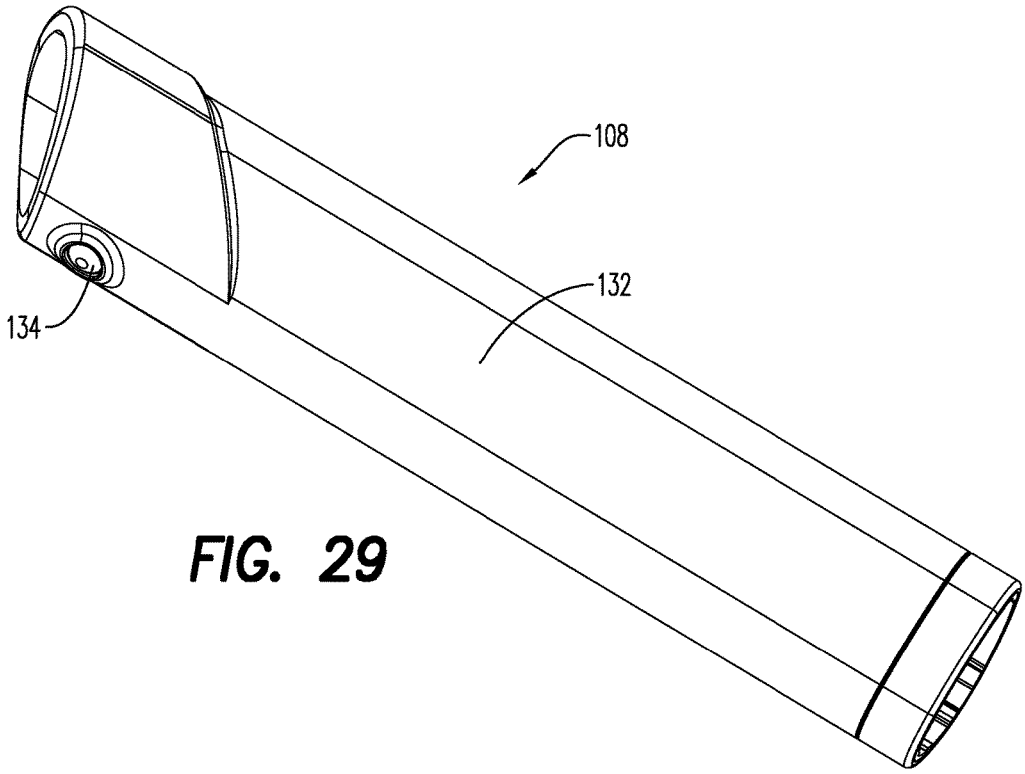
FIG. 29 is a bottom perspective view of the second pole connection assembly of FIG. 28.
Figure 30:
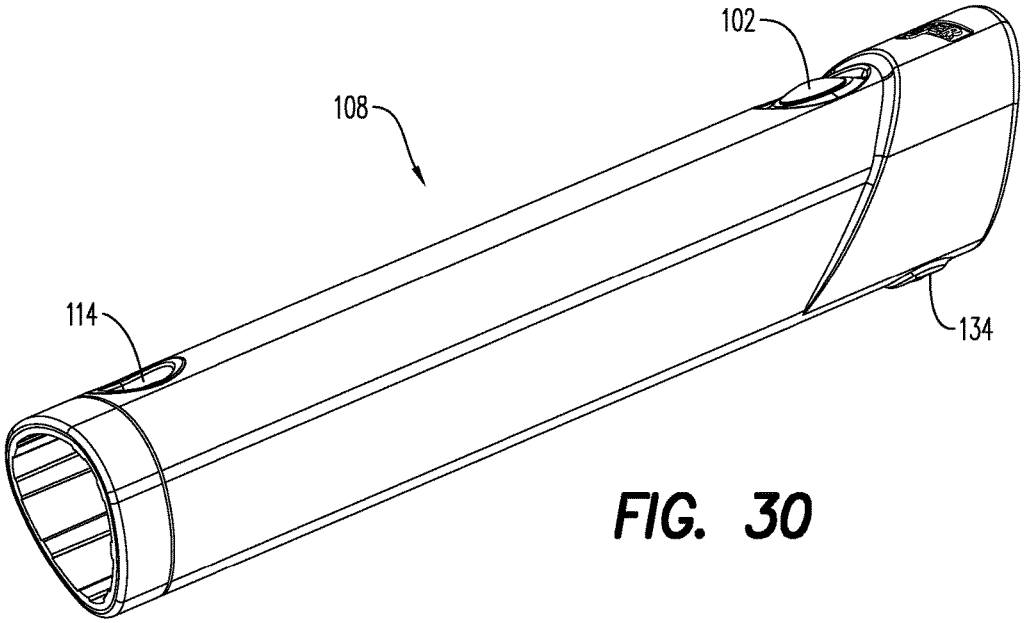
FIG. 30 is a side perspective view of the second pole connection assembly of FIG. 28.
Figure 31:
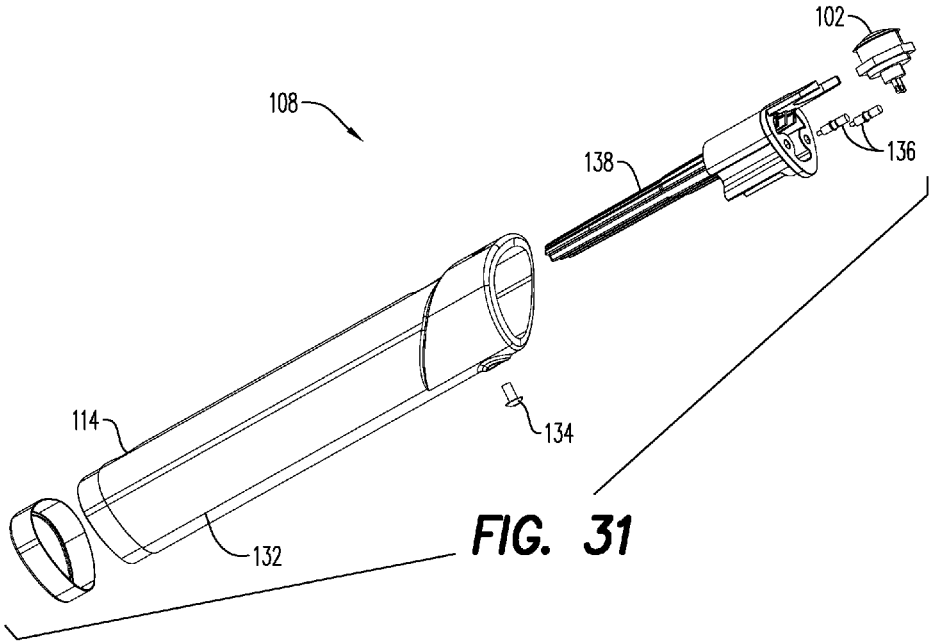
FIG. 31 is a side perspective, exploded view of the second pole connection assembly of FIG. 28.
Figure 32:
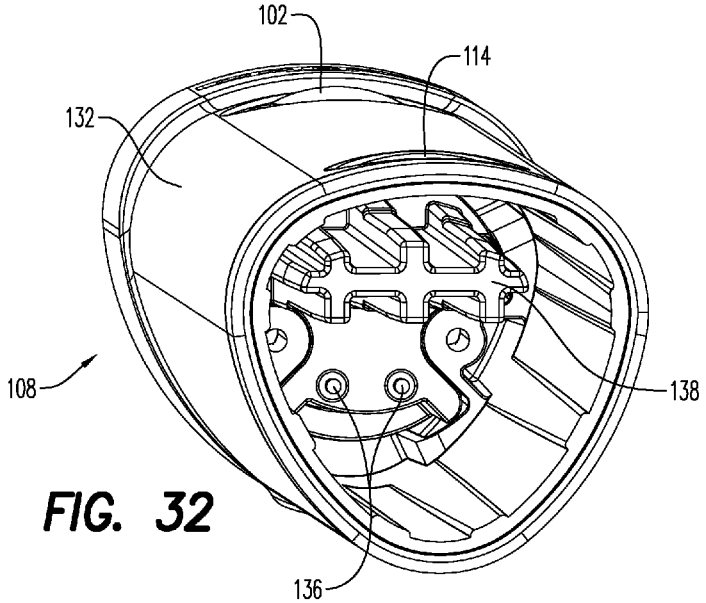
FIG. 32 is an end view of the second pole connection assembly of FIG. 28.

It has been found that, under certain cleaning activities, it may be desired to extend the reach of device 10 provided by handle 16. Accordingly, device 10 is configured for use with one or more extension poles 100 as shown in FIGS. 19-20 of the same or differing sizes.

Each of poles 100 includes an activation button 102 and the poles are configured so that, upon connection of the pole to handle 16 or to another pole 100, the activation button of the pole is placed in electrical communication with activation button of the handle 16. In this manner, pump 50—when device 10 is used with one or more poles 100—can be activated by button 56 on handle 16 and any of the buttons 102 on the poles.

Pole 100 is described in more detail with reference to FIGS. 21-32.

Pole 100 includes an extension member 104, a first pole connection assembly 106, and a second pole connection assembly 108. In the illustrated embodiment, extension member 104 is made of material such as, but not limited to metal (e.g., steel, aluminum), plastics, composite material (e.g., fiber glass, carbon fiber, etc), and other materials.

Member 104 has a hollow region 110 at least in the area of first pole connection assembly 106 in which the assembly is disposed. Of course, it is contemplated by the present disclosure for pole 100 to be entirely hollow.

Figure 33:
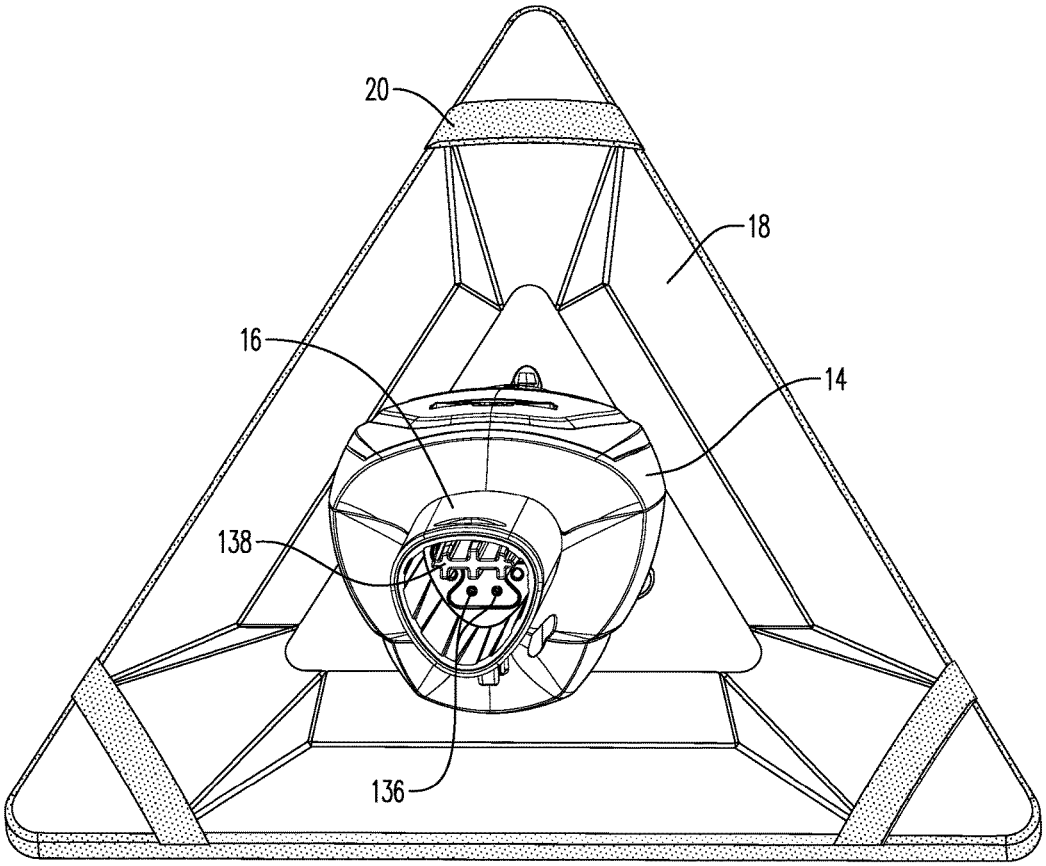
FIG. 33 is an end view of the cleaning device of FIG. 1 illustrating the elements of the second pole connection assembly.

First assembly 106 forms a portion of the physical and electrical interconnection between handle 16 and pole 100, as well as between poles. Similarly, second assembly 108 forms another portion of the physical and electrical interconnection between handle 16 and pole 100. While the second assembly 108 is described by way of example as part of pole 100, the features of the second assembly are also present in handle 16 to allow the first assembly 106 to physically and electrically connect to device 10. Thus, the features of second assembly 108 that are common to those on handle 16 are illustrated in FIG. 33.

Preferably, first assembly 106 is an internal assembly—namely is an assembly that is disposed substantially in the inner diameter of pole 100—while second assembly 108 is an external assembly—namely is an assembly that is disposed substantially around the outer diameter of pole 100. In this manner, the first assembly 106 can be thought of as the "male" portion of the interconnection and the second assembly 108 can be thought of as the "female" portion of the interconnection.

First assembly 106 includes a movable lock 112 that is removably received in a locking opening 114 of second assembly 108. When first assembly 106 is disposed in extension member 104, lock 112 is biased by a biasing member 116 (e.g., spring or other resilient member) through a passage in the extension member. Preferably, lock 112 has a tapered edge 118 that, when abutting the second assembly 108 during connection, acts as a cam surface to urge the button downward into extension member 104 by overcoming the return force of biasing member 116. However when lock 112 is in alignment or registration with locking opening 114 in second member 114, the biasing member 116 returns the lock to its normal, extended position where it resides in the locking opening to prevent separation of the poles 100 or pole 100 and handle 16, respectively.

During disconnection, the user can depress lock 112 overcoming the return force of biasing member 116 so that the lock is free from locking opening 114 in second member 114 to allow separation of the poles 100 or pole 100 and handle 16, respectively.

First assembly 106 includes a main body 120 that has a channel 122 in which lock 112 and biasing member 116 reciprocate vertically. Advantageously, channel 122 is open on at least one side 124, allowing the lock 112 and biasing member 116 to be installed into channel 122 from the side—then retained in position in the channel upon insertion into extension member 104.

First assembly 106 is secured in extension member 104 by way of a transverse pin 126. Further, first assembly 106 includes a pair of electrical contacts 128 and a guide member 130 which are described in more detail below in combination with features of second assembly 108.

Second assembly 108 includes a main body 132 in which locking opening 114 and activation button 102 are disposed. Second assembly 108 is secured over the outer diameter of extension member 104 by way of a transverse pin 134. Second assembly 108 also includes a pair of electrical contacts 136 and a guide member 138.

It is again noted that handle 16 functions in a manner similar to second assembly 108 and, thus, includes the elements of the second assembly necessary to form the desired physical and electrical connection with the first assembly 106 of pole 100. Accordingly, handle 16 includes lock opening 114, electrical contacts 136, and guide member 138 as shown at least in FIG. 33.

During assembly of first and second assemblies 106, 108 (i.e., assembly of two poles 100 to one another) and/or assembly of handle 16 with first assembly 106 (i.e., assembly of handle 16 with one pole 100), the guide members 130, 138 are mated to one another to provide positive location of contacts 128, 136 with respect to one another. The guide members 130, 138 are slid with respect to one another until locking member 112 is received in locking opening 114 to form the desired physical connection. Further and upon the completion of the physical connection, contacts 128, 136 also form an electrical connection therebetween.

It should be recognized that electrical contacts are illustrated as pin type contacts, but of course, it is contemplated by the present disclosure for contacts 128, 136 to be any contact type sufficient to provide the desired electrical conductivity such as, but not limited to, slide contacts.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

PARTS LIST

| | | |
|---|---|---|
| cleaning device 10 | pump inlet 60 | second assembly 108 |
| cleaning fluid pouch 12 | pump outlet 62 | hollow region 110 |
| housing 14 | first pathway 64 | movable lock 112 |
| handle 16 | second pathway 66 | locking opening 114 |

-continued

| PARTS LIST | | |
|---|---|---|
| cleaning head 18 | head inlet 68 | biasing member 116 |
| cleaning element 20 | upper cover 70 | main body 120 |
| spray nozzles 22 | lower cover 72 | channel 122 |
| central openings 24, 26 | support member 74 | open side 124 |
| cover 28 | port 76 | transverse pin 126 |
| internal cavity 30 | connector 78 | electrical contacts 128 |
| connection port 32 | pair of supports 80 | guide member 130 |
| closure member 34 | pivot member 82 | main body 132 |
| pouch port 36 | first axis 84 | transverse pin 134 |
| o-ring 38 | pair of arms 86 | electrical contacts 136 |
| slit valve 40 | second axis 88 | guide member 138 |
| upstanding arms 42 | connector 90 | |
| pivot axis 44 | 92 | |
| plate 46 | 94 | |
| seal 48a | 96 | |
| bottom 48b | 98 | |
| pleat 48c | extension poles 100 | |
| pump 50 | activation button 102 | |
| power source 52 | extension member 104 | |
| removable cover 54 | first assembly 106 | |
| activation button 56 | | |
| conduit path 58-1, 58-2 | | |

What is claimed is:

1. A method of cleaning a surface, comprising:

providing a cleaning head, a housing, and a pump, the pump having a port, the cleaning head having a nozzle, and the cleaning head and housing being connected to one another;

attaching a cleaning element with a first opening to the cleaning head so that the nozzle and the first opening are in registration;

providing a flexible pouch having a cleaning fluid therein;

connecting the port and the flexible pouch to form an air and fluid tight connection between the port and the flexible pouch;

placing the cleaning element on a surface to be cleaned; and pumping, via the pump, the cleaning fluid from the flexible pouch through the nozzle and the first opening onto the surface to be cleaned.

2. The method of claim 1, further comprising trapping any cleaning fluid from the nozzle between the cleaning head, the nozzle, the cleaning element, and the surface to be cleaned.

3. The method of claim 1, wherein the step of pumping further comprises causing the flexible pouch to collapse as the cleaning fluid is pumped by the pump.

4. The method of claim 1, wherein the pump is an electric pump and wherein the step of pumping comprises placing the electric pump in electrical communication with a power source.

5. The method of claim 1, wherein the flexible pouch comprises a liner of a fluid container.

6. The method of claim 1, wherein the cleaning head further comprises a second opening, the nozzle being positioned on the cleaning head so as to pump the cleaning fluid from the flexible pouch onto the surface being cleaned through the first and second openings.

7. The method of claim 1, wherein the nozzle is positioned on the cleaning head in a position selected from the group consisting of: recessed with respect to a bottom of the cleaning head, flush with the bottom of the cleaning head, and extending from the bottom of the cleaning head a distance less than a thickness of the cleaning element.

8. The method of claim 1, wherein the step of attaching the cleaning element to the cleaning head comprises removably attaching the cleaning element to the cleaning head.

9. The method of claim 1, wherein the flexible pouch comprises an internal valve that forms a selective fluid and air tight connection with the pump, the internal valve being opened by application of a negative pressure on the flexible pouch by activation of the pump and being closed by resilience of the internal valve upon removal of the negative pressure by deactivation of the pump.

10. The method of claim 9, wherein the internal valve is the only valve in a fluid path from the flexible pouch through the nozzle.

11. The method of claim 1, wherein the step of connecting the port and the flexible pouch comprises forming a removable fluid and air tight connection with an inlet of the pump.

12. The method of claim 1, wherein the port is pivotally secured in the housing for movement between a first position and a second position.

13. The method of claim 12, wherein the step of connecting the port and the flexible pouch comprises moving the port to the first position, connecting the port and the flexible pouch, and moving the port to the second position.

* * * * *